US010211577B2

(12) United States Patent
Milbrand, Jr. et al.

(10) Patent No.: US 10,211,577 B2
(45) Date of Patent: Feb. 19, 2019

(54) HIGH PERFORMANCE CABLE CONNECTOR

(71) Applicants: Donald W. Milbrand, Jr., Bristol, NH (US); Prescott B. Atkinson, Nottingham, NH (US); Brian Kirk, Amherst, NH (US)

(72) Inventors: Donald W. Milbrand, Jr., Bristol, NH (US); Prescott B. Atkinson, Nottingham, NH (US); Brian Kirk, Amherst, NH (US)

(73) Assignee: Amphenol Corporation, Wallingford, CT (US)

( * ) Notice: Subject to any disclaimer, the term of this patent is extended or adjusted under 35 U.S.C. 154(b) by 812 days.

(21) Appl. No.: 13/671,096

(22) Filed: Nov. 7, 2012

(65) Prior Publication Data

US 2013/0065454 A1 Mar. 14, 2013

Related U.S. Application Data

(63) Continuation of application No. PCT/US2011/035515, filed on May 6, 2011.
(Continued)

(51) Int. Cl.
*H01R 13/64* (2006.01)
*H01R 24/28* (2011.01)
(Continued)

(52) U.S. Cl.
CPC ..... *H01R 24/28* (2013.01); *H01R 12/7005* (2013.01); *H01R 12/724* (2013.01);
(Continued)

(58) Field of Classification Search
CPC . H01R 13/64; H01R 12/7005; H01R 23/7005
(Continued)

(56) References Cited

U.S. PATENT DOCUMENTS 5,166,527 A * 11/1992 Solymar ..... 313/634
5,277,610 A * 1/1994 Krehbiel et al. ..... 439/271
(Continued)

FOREIGN PATENT DOCUMENTS

CN 2798361 Y 7/2006
WO WO 2010/030622 A1 3/2010

OTHER PUBLICATIONS

International Search Report and Written Opinion from PCT Application No. PCT/US2011/035515 dated Oct. 21, 2011.
Office Action for CN 201180033750.3 dated Aug. 13, 2014.

*Primary Examiner* — Felix O Figueroa
(74) *Attorney, Agent, or Firm* — Wolf, Greenfield & Sacks, P.C.

(57) ABSTRACT

A cable connector with improved performance and ease of use. The connector has staggered ports to reduce crosstalk and to prevent incorrect insertion of a plug into a receptacle. The plug may be constructed with subassemblies, each of which has a lossy central portion. Conductive members embedded within an insulative housing of the subassemblies may be used to electrically connect ground conductors within the subassemblies. Further, the connector may have a quick connect locking screw that can be engaged by pressing on the screw, but requires rotation of the screw to remove. Additionally, a ferrule may be used in making a mechanical connection between a cable bundle and a plug and making an electrical connection between a braid of the cable bundle and a conductive shell of the plug. The ferrule may be in multiple pieces for easy attachment while precluding deformation of the cable, which disrupts electrical performance.

20 Claims, 12 Drawing Sheets

Related U.S. Application Data

(60) Provisional application No. 61/332,366, filed on May 7, 2010.

(51) Int. Cl.

| | |
|---|---|
| ***H01R 13/6599*** | (2011.01) |
| ***H01R 13/6585*** | (2011.01) |
| ***H01R 12/50*** | (2011.01) |
| ***H01R 12/70*** | (2011.01) |
| ***H01R 12/72*** | (2011.01) |
| ***H01R 13/6583*** | (2011.01) |
| ***H01R 13/6587*** | (2011.01) |
| ***H01R 43/20*** | (2006.01) |
| ***H01R 43/26*** | (2006.01) |
| *H01R 13/514* | (2006.01) |
| *H01R 13/6461* | (2011.01) |
| *H01R 13/6473* | (2011.01) |
| *H01R 24/60* | (2011.01) |

(52) U.S. Cl.

CPC ..... *H01R 13/64* (2013.01); *H01R 13/6583* (2013.01); *H01R 13/6585* (2013.01); *H01R 13/6587* (2013.01); *H01R 13/6599* (2013.01); *H01R 23/7005* (2013.01); *H01R 43/20* (2013.01); *H01R 43/26* (2013.01); *H01R 13/514* (2013.01); *H01R 13/6461* (2013.01); *H01R 13/6473* (2013.01); *H01R 24/60* (2013.01); *Y10T 29/49117* (2015.01); *Y10T 29/49204* (2015.01)

(58) Field of Classification Search

USPC ..... 439/607.05–607.07, 49, 701, 736, 677, 439/924.1

See application file for complete search history.

(56) References Cited

U.S. PATENT DOCUMENTS

| | | | | |
|---|---|---|---|---|
| 5,786,986 | A | 7/1998 | Bregman et al. | |
| 5,848,914 | A | 12/1998 | Lang et al. | |
| 5,971,784 | A * | 10/1999 | Fabian et al. | 439/218 |
| 6,561,847 | B1 | 5/2003 | Xiang et al. | |
| 6,582,244 | B2 | 6/2003 | Fogg et al. | |
| 6,652,318 | B1 | 11/2003 | Winings et al. | |
| 6,666,708 | B2 * | 12/2003 | Saito | 439/466 |
| 6,692,272 | B2 | 2/2004 | Lemke et al. | |
| 6,976,886 | B2 | 12/2005 | Winings et al. | |
| 6,981,883 | B2 | 1/2006 | Raistrick et al. | |
| 6,994,569 | B2 | 2/2006 | Minich et al. | |
| 7,585,189 | B2 * | 9/2009 | Wu et al. | 439/660 |
| 7,713,085 | B2 * | 5/2010 | Wu et al. | 439/541.5 |
| 7,794,278 | B2 | 9/2010 | Cohen et al. | |
| 7,824,197 | B1 * | 11/2010 | Westman et al. | 439/108 |
| 8,226,441 | B2 * | 7/2012 | Regnier et al. | 439/626 |
| 2002/0125967 | A1 | 9/2002 | Garrett et al. | |
| 2004/0166708 | A1 | 8/2004 | Kiely | |
| 2005/0170700 | A1 | 8/2005 | Shuey et al. | |
| 2005/0196987 | A1 | 9/2005 | Shuey et al. | |
| 2006/0009080 | A1 | 1/2006 | Regnier et al. | |
| 2008/0246555 | A1 | 10/2008 | Kirk et al. | |
| 2008/0318476 | A1 | 12/2008 | Weber et al. | |
| 2009/0011620 | A1 | 1/2009 | Avery et al. | |
| 2009/0291593 | A1 | 11/2009 | Atkinson et al. | |
| 2010/0081302 | A1 | 4/2010 | Atkinson et al. | |
| 2013/0078870 | A1 * | 3/2013 | Milbrand, Jr. | 439/676 |
| 2013/0078871 | A1 * | 3/2013 | Milbrand, Jr. | 439/676 |

* cited by examiner

HIGH PERFORMANCE CABLE CONNECTOR

RELATED APPLICATIONS

This application is a continuation of and claims the benefit under 35 U.S.C. §§ 120 and 365(c) of International Application PCT/US2011/035515, with an international filing date of May 6, 2011, and titled "HIGH PERFORMANCE CABLE CONNECTOR," which application is herein incorporated by reference in its entirety. This application also claims the benefit under 35 U.S.C. § 119(e) of U.S. Provisional Patent Application Ser. No. 61/332,366, filed on May 7, 2010, and titled, "HIGH PERFORMANCE CABLE CONNECTOR," which application is hereby incorporated herein by reference in its entirety.

FIELD OF THE INVENTION

This invention application relates generally to electrical interconnection systems and more specifically to interconnections between cables and circuit assemblies.

RELATED TECHNOLOGY

Electronic systems are frequently manufactured from multiple interconnected assemblies. Electronic devices, such as computers, frequently contain electronic components attached to printed circuit boards. One or more printed circuit boards may be positioned within a rack or other support structure and interconnected so that data or other signals may be processed by the components on different printed circuit boards.

Frequently, interconnections between printed circuit boards are made using electrical connectors. To make such an interconnection, one electrical connector is attached to each printed circuit board to be connected, and those boards are positioned such that the connectors mate, creating signal paths between the boards. Signals can pass from board to board through the connectors, allowing electronic components on different printed circuit boards to work together. Use of connectors in this fashion facilitates assembly of complex devices because portions of the device can be manufactured on separate boards and then assembled. Use of connectors also facilitates maintenance of electronic devices because a board can be added to a system after it is assembled to add functionality or to replace a defective board.

In some instances, an electronic system is more complex or needs to span a wider area than can practically be achieved by assembling boards into a rack. It is known, though, to interconnect devices, which may be widely separated, using cables. In this scenario, cable connectors, designed to make connections between conductors of cables and conductors of printed circuit boards within the devices may be used. The cable connectors may be separable, with a cable end terminated with a cable connector, sometimes called a "plug." A printed circuit board within the electronic device may contain a board-mounted connector, sometimes called a "receptacle," that receives the plug. Rather than being mounted to align with a connector on another board, the receptacle is positioned near an opening in an exterior surface, sometimes referred to as a "panel," of the device. The plug may be inserted through the opening in the panel, to mate with the receptacle, completing a connection between the cable and electronic components within the device.

An example of a board-mounted connector is the small form factor pluggable, or SFP, connector. SFP connectors have been standardized by an SFF working group and are documented in standard SFF 8431. Though, cable connectors in other form factors are known, including connectors made according to the QSFP standard.

SUMMARY

Improved electrical performance and ease of use of a cable connector may be provided through incorporation of one or more design features. These features may be used alone or in combination.

In one aspect, a receptacle may have mating contact portions of conductive elements forming multiple ports positioned such that the ports are staggered. This arrangement of the mating contact portions may reduce crosstalk through the cable connector. This arrangement also facilitates a housing for the receptacle that has an L-shaped profile on its mating face. A plug adapted for mating with such a receptacle may have a complementary profile on its mating face, allowing the plug to be inserted into the receptacle in only one orientation.

In another aspect, the plug may contain subassemblies, each of which provides mating contact portions for a port. The plug may be adapted to mate with staggered ports by mounting the subassemblies in a shell in a staggered arrangement.

Each sub-assembly may comprise at least two insulative housings, each holding a plurality of conductive elements. Two such subassemblies may be mounted with mating contact portions of the respective conductive elements facing outwards and an electrically lossy member between the insulative housings.

In some embodiments, the conductive elements of each sub-assembly may contain conductive elements sized and positioned to act as a differential pair. The differential pairs may be separated by conductive elements adapted to act as ground conductors. The lossy member may have projections extending through the insulative housings towards the ground conductors, coupling the ground conductors to the lossy member.

In another aspect, each of the subassemblies may have a conductive segment, embedded in the insulative housings. The conductive segment may connect the distal ends of the mating contact portions of the ground conductors, thereby improving electrical performance. In some embodiments, such a conductive segment may be stamped as part of a lead frame from which the plurality of conductive elements are formed. When the lead frame is formed, the conductive segment may be positioned out of the plane of the mating contact portions of the conductive elements. When an insulative housing is molded over the lead frame, the conductive segment is mechanically and electrically isolated from mating contact portions in a mating connector.

In another aspect, a plug may be designed for quick, yet secure, connection to a receptacle assembly. The plug may contain a screw that may slide within the shell. A receptacle assembly may have an opening adapted to receive a threaded end of the screw when the plug and receptacle are mated. The receptacle assembly may include a compliant member adjacent such a hole. Once the plug is mated with the receptacle, a user may press on the screw. The compliant member may deflect, allowing threads of the screw to slide past an end of the compliant member as the screw enters the hole. The compliant member may be shaped to engage a thread on the screw if the screw is pulled in a direction to remove the screw from the hole. Consequently, the plug is quickly and securely attached to the receptacle assembly, though the screw may be removed by rotation of the screw to slide the thread over the compliant member.

In yet another aspect, a plug may be designed for simple, yet robust, connection to a cable bundle in a fashion that preserves desirable electrical properties in the cable attachment region. A ferrule may be used at an end of a cable to be attached to plug. The ferrule may have two or more pieces that can be easily inserted under a jacket of the cable. Though, the pieces, collectively, may form a tubular surface resistant to deformation by radial forces on the cable. A braid from within the cable may be exposed exterior to the cable jacket. Attachment of a shell may generate a radial force pinching the jacket and braid between the shell and ferrule, securing the shell to the cable bundle. The radial force may also press the shell and braid together, making an electrical connection between the shell and braid in embodiments in which the shell is formed of a conductive material. Interior portions of the cable bundle, holding signal conductors are not deformed by this force because the presence of the ferrule.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

A cable connector according to embodiments of the invention may be used to interconnect electronic devices as is known in the art. However, the cable connector may include features that provide desirable electrical performance, such as reduced crosstalk between signals propagating through interconnection system less attenuation or more uniform attenuation at frequencies of signals to be conveyed through the interconnection system. In some embodiments, the interconnection system may provide acceptable attenuation over a frequency range up to 16 GHz or beyond.

Features to provide this electrical performance may be incorporated in connectors that are easy to use. Such connectors may facilitate quickly and reliably making multiple connections to an electronic device, such as a router or a telecommunications switch, to which multiple other devices may be connected through cables.

Figure 1:
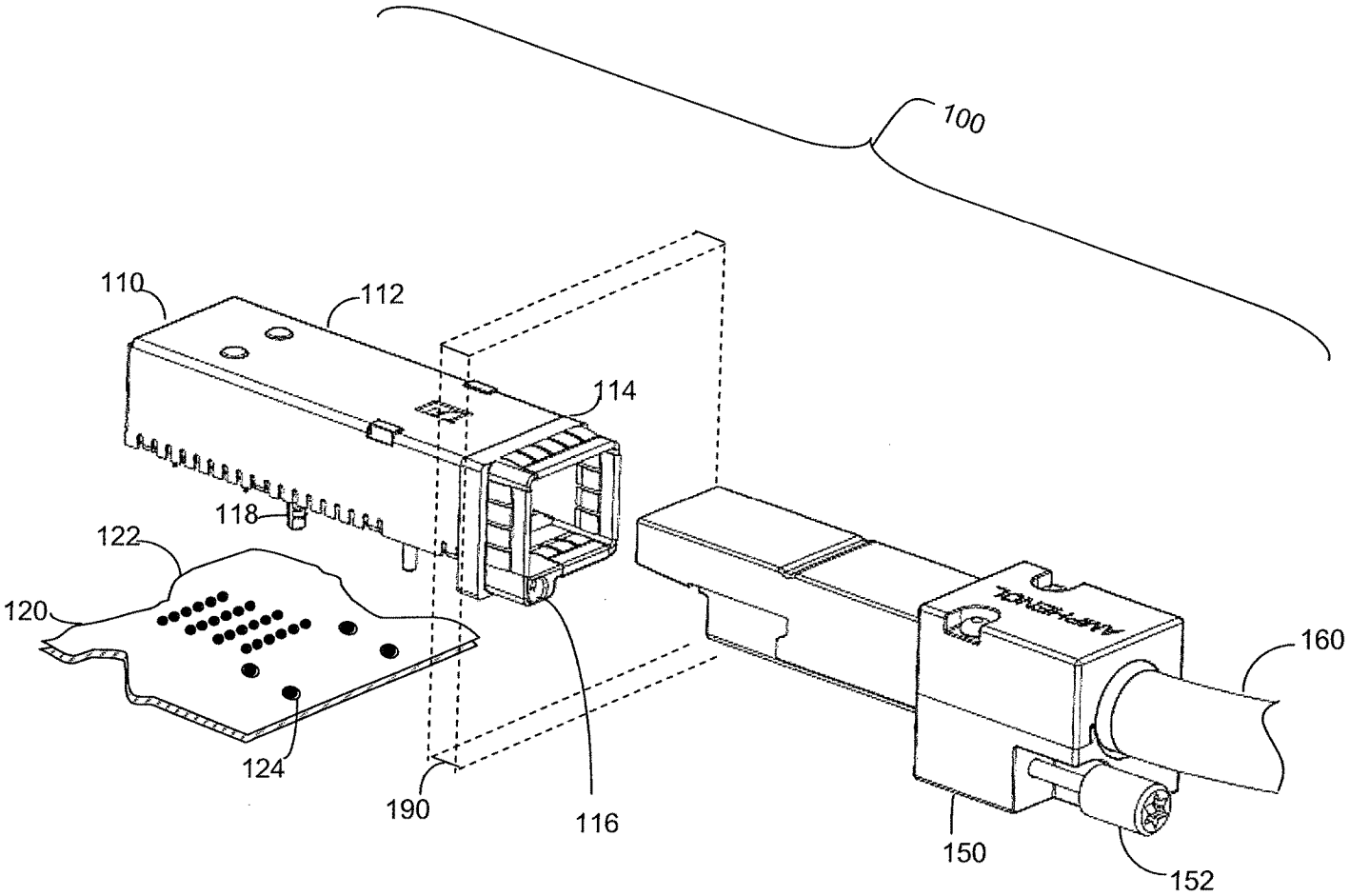
FIG. 1 is a perspective view of an electronic assembly incorporating an interconnection system according to some embodiments of the invention.

FIG. 1 is a sketch of an interconnection system 100 in which embodiments of the invention may be practiced. FIG. 1 provides a simplified view of portions of an electronic device that may be connected to other electronic devices through cable bundle 160. The electronic device includes a printed circuit board 120 contained within an enclosure that includes a panel 190, a portion of which is shown in phantom in FIG. 1.

Electronic components may be mounted to printed circuit board 120, and printed circuit board 120 may contain other connectors to connect printed circuit board 120 to other printed circuit boards within the device. These components may be as known in the art and are not shown for simplicity.

The simplified example of FIG. 1, shows only a portion of the electronic device where cable bundle 160 is connected to the device. Though one such cable bundle is shown, it should be appreciated that electronic devices may connect to multiple cable bundle. To facilitate more such connections, additional components could be included, effectively duplicating interconnection system 100 for each cable bundle to make connections to components within the electronic device. Therefore, embodiments are possible in which panel 190 includes multiple openings, each adapted to receive a cable connector. These openings may be arrayed in rows or disposed in any suitable way, but are not expressly illustrated for simplicity of illustration.

In the embodiment illustrated, receptacle assembly 110 is attached, along a lower face, to printed circuit board 120. To facilitate attachment to printed circuit board 120, receptacle assembly 110 includes mounting features 118. In the example of FIG. 1, mounting features 118 are in the shape of posts extending from receptacle assembly 110 towards printed circuit board 120. Attachment is made by inserting each of the mounting features 118 into a respective mounting hole 124 on printed circuit board 120. In this example, mounting features 118 and mounting holes 124 provide a mechanical coupling between receptacle assembly 110 and printed circuit board 120.

In addition, electrical connections may be made between printed circuit board 120 and conductive elements of receptacle assembly 110. Mounting features 118 may additionally, or alternatively, provide such electrical connection. In some embodiments, portions of receptacle assembly 110 may be connected to an electrical ground. For example, cage 112 that provides an outer casing for receptacle assembly 110 may be formed of conductive material that may be connected to ground, to reduce interference with other components of the electronic device caused by electromagnetic radiation emanating from receptacle assembly 110. In these embodiments, mounting features 118 may be conductive and interior walls of mounting hole 124 may be connected to ground within printed circuit board 120.

Other electrical connections between printed circuit board 120 and receptacle assembly 110 may be used to couple electrical signals some or all of these signal may be high speed differential signals, such as digital data signals communicating digital data at a rate between 1 Gbps and 8 Gbps. In the embodiment illustrated, electrical connections for signals are formed between receptacle assembly 110 and printed circuit board 120 by inserting projections (not shown in FIG. 1) from receptacle assembly 110 into holes in printed circuit board 120. In the example of FIG. 1, the holes form a connector footprint 122. Each of the holes within connector footprint 122 may be electrically connected within printed circuit board 120 to a trace, a ground plane or other conductive structure. Projections inserted into the holes 122 make electrical connection, via the holes, to the conducting structures within printed circuit board 120. In this way, signals and reference potentials may be coupled between components on printed circuit board or otherwise within the electronic device to conductive elements (not shown in FIG. 1) within receptacle assembly 110.

Though, it should be recognized that projections inserted into via holes on the printed circuit board are only one example of a mechanism that may be used to make electrical connections between conductive elements within receptacle assembly 110 and conductive elements within printed circuit board 120. More generally, the conductive elements within receptacle assembly 110 may include tails extending from receptacle assembly 110 that may be attached to conductive structures on printed circuit board 120 in any suitable way. The tails may be soldered within the holes, may have compliant segments that form press fit connections when inserted in the holes or the tails may be attached to conductive pads on the service of printed circuit board 120, without being inserted into the holes. Accordingly, the specific structure of the tails extending from conductive elements within receptacle assembly 110 and the specific mechanism by which the tails are attached to printed circuit board 120 are not critical to the invention.

In addition to making electrical connections, the projections from receptacle assembly 110 that are attached to footprint 122 may also provide mechanical attachment of receptacle assembly 110 to printed circuit board 120. Though, any suitable combination of features may be used for making electrical and/or mechanical connections between receptacle assembly 110 and printed circuit board 120.

The projections from receptacle assembly 110 may serve as tails for conductive elements that propagate signals through receptacle assembly 110 to one or more ports (not visible in FIG. 1) where those conductive elements may mate with conductive elements (not visible in FIG. 1) within plug 150. As shown in FIG. 1, receptacle assembly 110 is positioned within an opening in panel 190 such that plug 150 may be inserted into an opening of receptacle assembly 110. In this configuration, a mating face of plug 150 engages a mating face of a receptacle within receptacle assembly 110.

Once plug 150 is inserted into receptacle assembly 110, it may be secured with an attachment mechanism. In this example, the attachment mechanism includes lock screw 152. Once plug 150 is inserted into receptacle assembly 110, lock screw 152 aligns with hole 116 in receptacle assembly 110. Interior portions (not visible in FIG. 1) of receptacle assembly 110 adjacent hole 116 may be adapted to engage a threaded end (not visible in FIG. 1) of lock screw 152. In this way, plug 150 may be secured to receptacle assembly 110 and therefore to the electronic device incorporating receptacle assembly 110, by engaging lock screw 152. Conversely, plug 150 may be separated from the electronic device by unscrewing lock screw 152 and removing plug 150.

Other features of interconnection system 110 are also visible in FIG. 1. Receptacle assembly 110 is shown with an EMI gasket 114. EMI gasket 114 provides a seal between receptacle assembly 110 and panel 190 and reduces the amount of electromagnetic radiation emanating from receptacle assembly 110 or from entering receptacle assembly 110.

Figure 2:
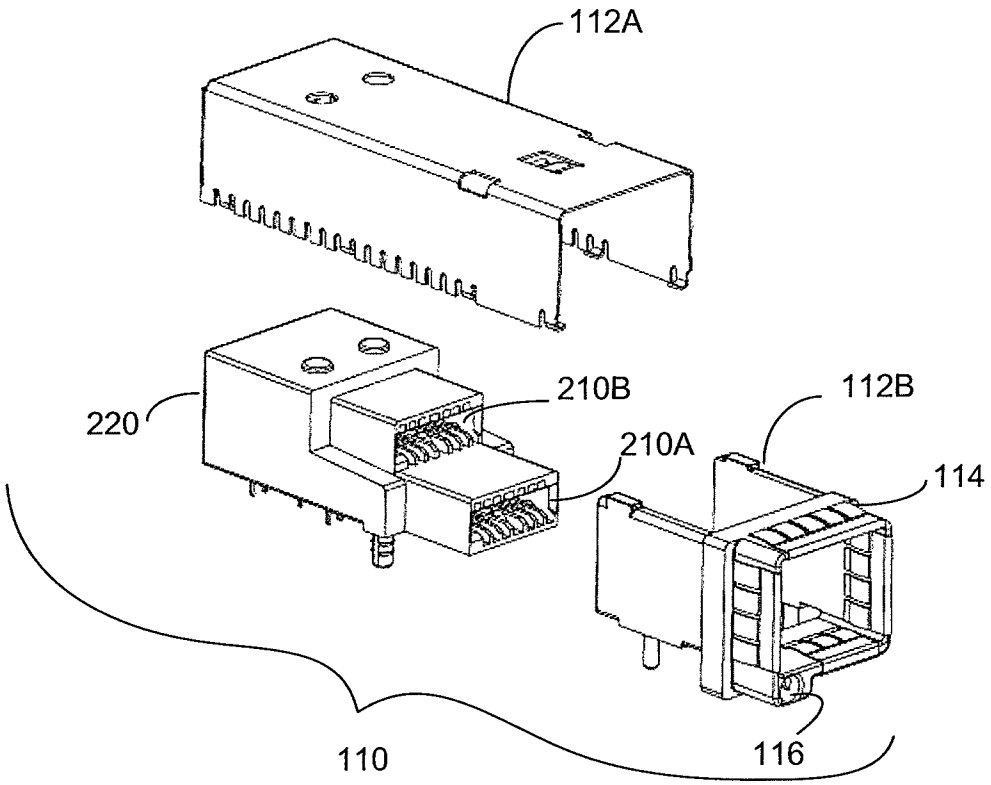
FIG. 2 is a partially exploded view of a receptacle assembly according to some embodiments of the invention.

FIG. 2 is a partially exploded view of receptacle assembly 110. FIG. 2 reveals that receptacle assembly 110 may be constructed such that cage 112 (FIG. 1) encloses a receptacle 220. Further, FIG. 2 shows that cage 112 may be constructed from multiple components. In this example, cage 112 is constructed from cage body 112A and front member 112B. Though cage 112 may be assembled from any suitable number of components.

In the embodiment illustrated in FIG. 2, the components of cage 112 may be partially or totally conductive. In some embodiments, cage body 112A may be formed by bending a sheet of metal to have generally U-shaped cross section such that cage body 112A fits over receptacle 220. Though, any suitable construction technique may be used to form cage body 112A.

Front member 112B may also be formed from conductive materials according to any suitable techniques. With front member 112B attached to cage body 112A, receptacle 220 may be enclosed within cage 112, preventing electromagnetic radiation from emanating from receptacle 220 and interfering with electronic circuitry in the vicinity of receptacle 220.

Cage 112 may also guide a plug 150 (FIG. 1) into engagement with receptacle 220. A plug inserted into an opening in panel 190 surrounded by cage 112 will be positioned by cage body 112A to align with receptacle 220. In the example of FIG. 2, receptacle 220 is formed with two ports, port 210A and 210B. Each of the ports 210A and 210B is shaped to receive a generally planar member from plug 150. Each of the ports 210A and 210B may contain mating contact portions of conductive elements (not visible in FIG. 2) within receptacle 220. The mating contact portions may be positioned within the ports 210A and 210B to make electrical connection with complimentary mating contact portions on the planar members from the plug.

Figure 3:
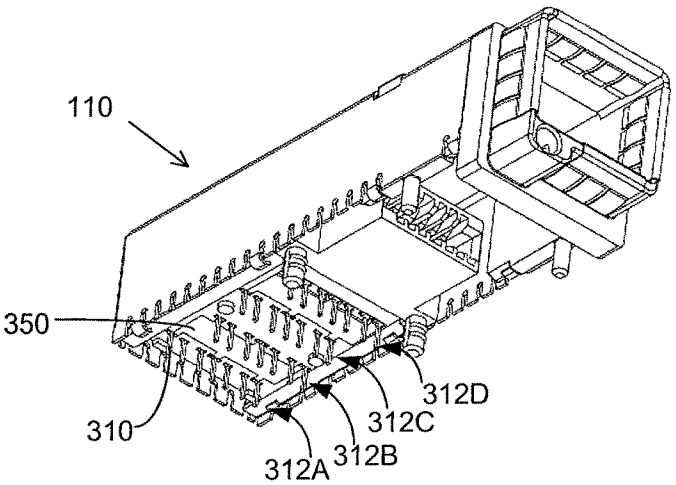
FIG. 3 is a view from below of a receptacle assembly according to some embodiments of the invention.

FIG. 3 shows an alternative view receptacle assembly 110, revealing a lower surface 350 of receptacle 220. Contact tails (of which contact tail 310 is numbered) of conductive elements within receptacle 220 extend through lower surface 350. In this embodiment, the conductive elements are positioned in four columns such that four columns, 312A, 312B, 312C and 312D of contact tails are visible in the view of FIG. 3.

In the embodiment illustrated, conductive elements in each of two columns extend into one of the ports 210A or 210B. In the specific example of FIG. 3, columns 312A and 312B contain contact tails for conductive elements that extend into port 210B. Columns 312C and 312D contain contact tails for conductive elements that extend into port 210A. Accordingly, when the contact tails in columns 312A and 312B are secured to holes within footprint 122, they provide an electrical connection between conductive elements within printed circuit board 120 (FIG. 1) and conductive elements within port 210B. Likewise, when the contact tails in columns 312C and 312D are attached to holes within footprint 122, they complete an electrical connection between conductive elements within printed circuit board 120 and mating contact portions within port 210A.

Figure 4:
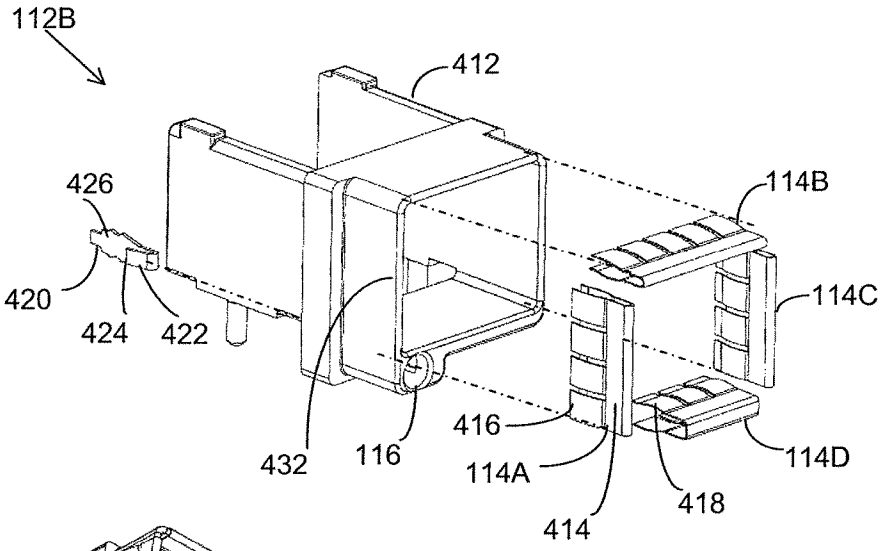
FIG. 4 is a partially exploded view of a front housing portion of a receptacle assembly according to some embodiments of the invention.

Turning to FIG. 4, additional details of front member 112B are illustrated. In the embodiment illustrated in FIG. 4, front member 112B is formed from a front housing portion 412 to which EMI gasket members 114A, 114B, 114C and 114D are attached. Front housing portion 412 may be formed of a conductive material. For example, front housing portion 412 may be formed of metal using a die casting process. Though, any suitable construction techniques or materials may be used.

Gasket elements 114A, 114B, 114C and 114D may be formed in any suitable way. In the embodiment illustrated, the gasket elements are each formed from a sheet of metal that is stamped and bent into the shapes shown. Each of the gasket elements may be U-shaped to fit around wall of front housing portion 412. Each of the gasket elements also may be formed with multiple flexible fingers extending from a common base portion (of which common base portion 414A is numbered). The common base portion of each of the gasket elements 114A . . . 114D may be attached to a wall surrounding an opening in front housing portion 412 through which plug 150 (FIG. 1) may pass. The common base portion (of which common base portion 414 on gasket element 114A is numbered) may be attached to a wall, such as wall 432 surrounding an opening in front housing portion 412 using any suitable attachment technique. As an example, common base portion 414 may be welded to wall 432. With this attachment, a subset of the fingers (of which finger 416 is numbered) may extend outwardly from the opening in front housing portion 410. Another subset of the fingers (of which finger 418 is numbered) may extend into the opening of front housing portion 412.

In the example of FIG. 4, both the outwardly extending and inwardly extending fingers are formed of a springy metal such that each finger is compliant. Accordingly, inwardly extending fingers (of which finger 418 is numbered) may press against a shell of plug 150 inserted into the opening in front housing portion 412. Outwardly extending fingers (of which finger 416 is numbered) may press against an opening in panel 190 (FIG. 1) when receptacle assembly 110 is inserted into the opening of the panel. In this way, gasket elements 114A . . . 114D may block openings between a plug inserted into front housing portion 412 and panel 190, thereby forming a seal blocking the passage of electromagnetic radiation.

In addition, front housing portion 412 is shaped to provide a hole 116 into which lock screw 152 may be inserted. In the embodiment illustrated, hole 116 may be formed to provide a quick connect feature for lock screw 152. The quick connection features allow lock screw 152 to engage front housing portion 412 without requiring lock screw 152 to be rotated.

To support this quick connect feature, hole 116 may have a generally smooth inner diameter equal to or greater than the maximum diameter of a thread on a threaded end of lock screw 152. A retention element 420 also may be included. Here, retention element 420 is J-shaped and is held within format housing portion 114. To hold lock screw 152 within hole 116, a compliant member 422 projects into hole 116 on retention element 420 and forms an acute angle with respect to a base portion 426. Insertion of lock screw 152 may deflect compliant member 422 such that lock screw 152 may enter hole 116. Compliant member 422 may be positioned such that once a portion of the thread is pushed passed the distal end 424 of compliant member 422, the distal end 424 will engage the thread, thereby preventing lock screw 152 from being withdrawn from hole 116 without rotating the screw.

In the embodiment illustrated in FIG. 4, compliant member 422 is a portion of retention element 420. Retention element 420 includes a base 426 that may be fixed within an opening in front housing portion 412. That opening may be adjacent hole 116 such that when base 426 is secured to front housing portion 412, compliant member 422 projects into hole 116. Further detail of this locking arrangement is illustrated in conjunction with FIG. 15, below.

Figure 5:
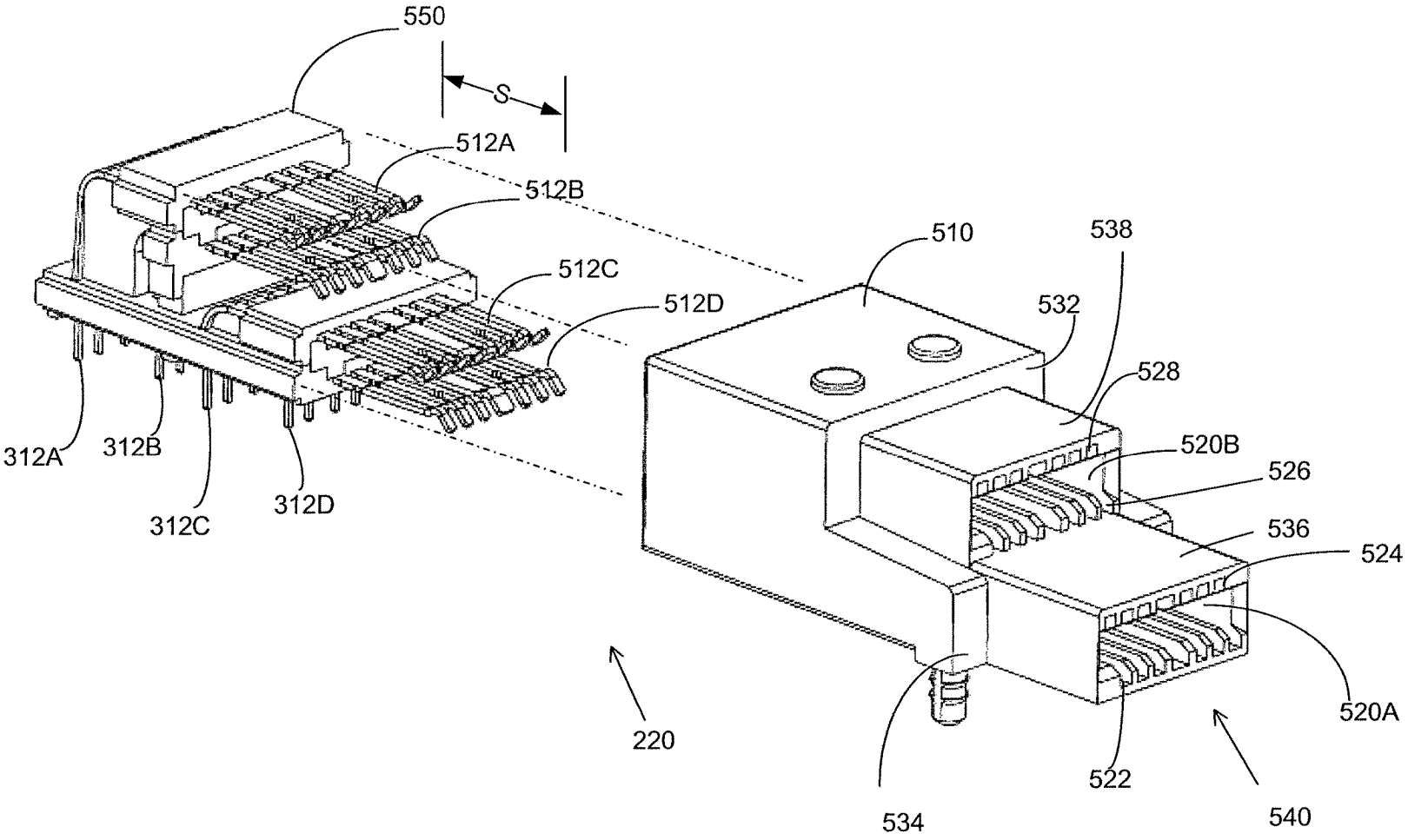
FIG. 5 is a partially exploded view of a receptacle according to some embodiments of the invention.

Turning to FIG. 5, additional detail of receptacle 220 is illustrated. In the example of FIG. 5, receptacle 220 is formed from an insulative housing 510 and a lead sub-assembly 550.

Insulative housing 510 may be formed in any suitable way, including molding of a thermal plastic material. Housing 510 may be formed of an insulative material. For example, it may be molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form housing 510 to control the electrical or mechanical properties of housing 510. For example, thermoplastic PPS filled to 30% by volume with glass fiber may be used.

In the example embodiment of FIG. 5, housing 510 is formed with two cavities, 520A and 520B. Cavity 520A has a lower surface 522 and an upper surface 524. Cavity 520B has a lower surface 526 and an upper surface 528. Each of the surface 522, 524, 526 and 528 is shaped to receive a column of mating contacts portions of conductive elements within receptacle 220. When lead sub-assembly 550 is inserted into housing 510, a column of mating contact portions is positioned along each of the surfaces. Column 512A of mating contact portions is positioned along surface 528. Column 512B of mating contact portions is positioned along surface 526. Column 512C of mating contact portions is positioned along surface 525 and column 512D of mating contact portions is positioned along surface 522. In this example, the mating contact portions form linear arrays of contacts along the surfaces of the cavities. Though, any suitable pattern of contact portions may be used.

In this example, the mating contact portions of receptacle 220 are shaped as compliant beams. As can be see in FIG. 5, each of the surfaces 522, 524, 526 and 528 includes slots into which individual mating contact portions may fit, allowing compliant motion of the mating contact portions when a member is inserted into cavity 520A or 520B. Consequently, cavity 520A in combination with columns 512C and 512D of mating contact portions forms port 210A (FIG. 2) into which a member from plug 150 (FIG. 1) may be inserted. Likewise, cavity 520B in combination with columns 512A and 512B of mating contact portions forms port 210B, into which a second member of plug 150 may be inserted when receptacle 220 is mated with plug 150.

Figure 6:
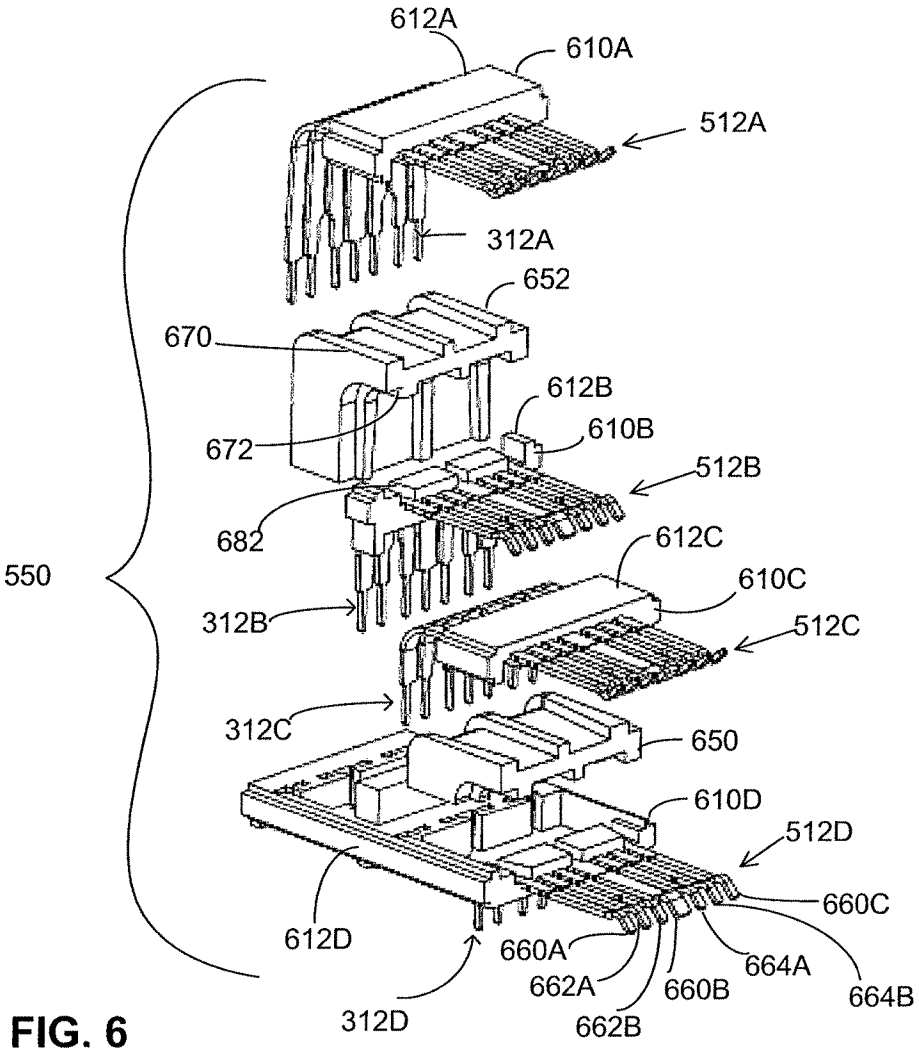
FIG. 6 is an exploded view of a portion of a receptacle according to some embodiments of the invention.

Turning to FIG. 6, additional details of lead sub-assembly 550 are illustrated. In the illustrated embodiment, each of the columns of conductive elements is held within a separate assembly. In the example of FIG. 6, lead assemblies 610A, 610B, 610C and 610D are shown. In this example, each of the lead assemblies 610A . . . 610D includes a column of conductive elements held within an insulative housing portion. Lead assembly 610A includes a column of conductive elements for which column 312A of contact tails and column 512A of mating contact portions can be seen.

Intermediate portions (not numbered) of the conductive elements are also visible in the illustration of FIG. 6. The intermediate portions are held within housing member 612A. Housing member 612A may be an insulative material, including a material of the type used to form housing 510. Lead assembly 610A may be formed in any suitable way, including molding housing member 612A over a portion of the conductive elements in lead assembly 610A. Though, other construction techniques may be employed, including inserting the conductive elements into housing member 612A.

Lead assembly 610B may be similarly formed, with a housing member 612B holding intermediate portions of a column of conductive elements with a column 312B of contact tails and column 512B of mating portions extending from housing member 612B. Lead assembly 610C may likewise be formed in similar way to secure a column of conductive elements with a column 312C of contact tails and a column 512C of mating contact portions.

Lead assembly 610D may be similarly formed, with a housing member 612D securing a column of conductive elements such that a column 312D of contact tails and a column 512D of mating contact portions are exposed. Additionally, housing member 612D may also act as an organizer for the components of lead sub-assembly 550. Housing member 612D may be formed with a lower surface 350 (FIG. 3) containing multiple columns of holes (not numbered) through which columns 312A, 312B and 312C of contact tails may be inserted. Housing member 612D may therefore act as a support member for other components of lead sub-assembly 550.

Improved electrical performance may be provided by inserts separating adjacent ones of the lead assemblies 610A . . . 610D. In the embodiment illustrated in FIG. 6, insert 650 separates lead assemblies 610C and 610D. Insert 652 separates lead assemblies 610A and 610B. In this example, an insert is provided between lead assemblies containing mating contact portions positioned on opposing surfaces of the same port. Though, in other embodiments, inserts may be included between lead assemblies containing conductive elements of different ports. In some embodiments, inserts 650 and 652 may be of insulative material and may serve a mechanical support function. In other embodiments, inserts, such as inserts 650 and 652, may instead of or in addition to providing mechanical support alter the electrical performance of interconnection system 110. In the embodiment illustrated, each of inserts 650 and 652 may be at least partially conductive. In some embodiments, the inserts may be formed of metal or other material that may be regarded as a conductor. In other embodiments, the inserts may be formed of a lossy material.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In other embodiments, the lossy materials maybe electromagnetic absorptive material, include ferrule magnetic materials.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in inserts 650 and 652 may be disposed generally evenly throughout, rendering a conductivity of the lossy portion generally constant. In other embodiments, a first region of inserts 650 and 652 may be more conductive than a second region of insert 650 and 652 so that the conductivity, and therefore amount of loss within inserts 650 and 652 may vary. In embodiments in which the lossy material is magnetically lossy material, the filler may include ferrous materials.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used.

Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive perform, such as those sold by Techfilm of Billerica, Mass., US may also be used. This preform can include an epoxy binder filled with carbon particles. The binder surrounds carbon particles, which acts as a reinforcement for the preform. Such a preform may be shaped to form all or part of inserts 650 and 652 and may be positioned to adhere to ground conductors in the connector. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

Regardless of the specific material used, inserts 650 and 652 may be formed in any suitable way. In the embodiment illustrated, inserts 650 and 652 are formed by molding a lossy material into a suitable shape, such as the shape illustrated in FIG. 6. In the embodiment illustrated in FIG. 6, inserts 650 and 652 are shaped to selectively couple electrically to one or more of the conductive elements within the columns of conductive elements. To support selective coupling, each of the inserts may have projections on outwardly facing surfaces. For example, insert 652 has projections (of which projection 670 is numbered) on an upward facing surface and projections (of which 672 is numbered) on a lower surface. Each of the projections is positioned to couple to a conductive element in a column of conductive elements in an adjacent lead assembly. In this example, projections on the upper surface of insert 652 are positioned to couple to selective ones of the conductive elements within lead assembly 610A. Projections from the lower surface of insert 652 are positioned to make contact with selected ones of the conductive elements within lead assembly 610B.

Similarly, projections from an upper surface of insert 650 are positioned to make contact with selected ones of the conductive elements in lead assembly 610C. Projections from a lower surface of insert 650 are positioned to make contact with selected ones of the conductive elements in lead assembly 610D. The conductive elements to which the inserts are coupled may be selected based on an intended function of the conductive elements within interconnection system 110. In the specific embodiment illustrated, interconnection system 110 is adapted to carry differential signals. Accordingly, certain ones of the conductive elements in a column will be arranged in pairs, with each conductive element in the pair having similar electrical properties. Taking lead assembly 610D as illustrative, a first differential pair is formed by conductive elements 662A and 662B. A second differential pair is formed by conductive elements 664A and 664B.

Each column of conductive elements may include in addition to signal pairs, multiple conductive elements designed to be ground conductors. In this example, the column of conductive elements includes ground conductors 660A, 660B and 660C. Here, the conductive elements are positioned in the column to create a pattern of ground, signal pair, ground, signal pair, ground. Projections (not numbered) from a lower surface of insert 650 may be positioned to make contact with the ground conductors, 660A, 660B and 660C. A similar pattern of conductive elements, with similar contact between the lossy insert and the grand conductors, may be used in each of the lead assemblies 610A . . . 610D.

To facilitate contact between inserts 650 and 652 and the ground conductors, the housing members 612A . . . 612D may be shaped with slots that expose portions of the conductive elements acting as ground conductors. For example, housing member 612B is shown with slots (of which slot 682 is numbered) exposing ground conductors. Projection 672 from the lower surface of insert 652 may fit within slot 682, thereby either contacting a conductive element acting as a ground conductor in lead assembly 610B or being positioned enough close to the ground conductor that electrical coupling between the ground conductor and the projection 672 occurs. Other projections from the lower surface of insert 652 may similarly contact the other ground conductors in lead assembly 610B. Projections (of which projection 670 is numbered) from the upper surface of insert 652 may similar extend into slots in housing member 612A to couple to ground conductors in lead assembly 610A. Projections from the upper the lower surface of insert 650 may likewise extend into slots in housing members 612C and 612D respectively, to couple to the ground conductors in lead assemblies 610C and 610D, respectively.

In this way, when the elements of lead sub-assembly 550 are assembled, ground conductors for each of the ports may be joined through a common lossy member, which has been found to improve the integrity of high speed signals passing through interconnection system 100.

FIG. 5 illustrates a further feature that may be used to improve the integrity of high speed signals passing through interconnection system 100. FIG. 5 shows columns 512A and 512B of mating contact portions are vertically aligned such that when lead sub-assembly 550 is inserted into housing 510 columns 512A and 512B will each be positioned along a surface, 528 and 526, respectively of cavity 520B. Similarly, columns 512C and 512D are vertically aligned such that when lead sub-assembly 550 is inserted into housing 510, columns 512C and 512D will line surfaces 524 and 522, respectively, of cavity 520A. With this positioning, the mating contact portions in columns 512A and 512B form mating contacts within port 210B (FIG. 2) and the mating contact portions in columns 512C and 512D form mating contact portions in port 210A. Each of these ports is accessible through mating face 540 of receptacle 220.

However, as can be seen in FIGS. 2 and 5, ports 210A and 210B are staggered in a horizontal dimension. With this configuration, ports 210A and 210B are offset in a direction parallel to lower surface 350, which in use may be mounted against printed circuit board 120 (FIG. 1). This mounting configuration provides horizontal separation between the mating contact portions of the conductive elements in forming port 210A and 210B. This separation is illustrated by the dimension S in FIG. 5. This offset provides both horizontal and vertical separation between the mating contact portions of the conductive elements within ports 210A and 210B. This separation reduces the extent to which from the mating contact portions of the conductive elements in one port will impact the integrity of signals in the other port.

Further, offsetting the ports in a right angle connector reduces the length of conductive elements in upper port 210B relative to lengths that may exist in a conventional connector in which ports are vertically aligned. Reducing the length of the conductive elements in upper port 210B may reduce the effect of electromagnetic radiation on those conductive elements, which may be reflected as noise in signals propagating along the conductive elements. Additionally, the conductive elements in port 210B is more nearly equal to the length of the conductive elements in port 210A, which may also contribute to desirable signal properties where differences in propagation delay among signals passing through an interconnection system is undesirable.

The off-set configuration of ports 210A and 210B also facilitates incorporation of mechanical features contributing to ease of use of interconnection system 100. Staggering the ports facilitates incorporation of an irregular contour in the forward face of receptacle 220. A plug adapted to mate with receptacle 220 may have an irregular contour that is complimentary to the contour of receptacle 220 when the plug is positioned in the intended orientation for mating with receptacle 220. In the example of FIG. 5, an irregular contour is provided in mating face 540 through the positioning of portions 536 and 538 of housing 510. Portion 536 contains port 210A and portion 538 contains port 210B.

A plug adapted to mate with receptacle 534 may have a forward face that similarly has an irregular profile. The plug may include planar members designed to fit within cavities 520A and 520B when the plug has an intended orientation with respect to receptacle 220 such that the irregular contour of the plug conforms to the irregular contour of the receptacle. However, the plug may have a mating face with portions that will contact one or more of the portions of the mating face 540 if the plug is inserted into receptacle assembly 110 with any other orientation. The plug, for example, may have a portion that contacts portion 536 of receptacle 220, blocking any portion of the plug from entering cavities 520A or 520B. Though, when property inserted, a shell of the plug may contact wall 532 while following the contour of shoulder 534.

Figure 7A:
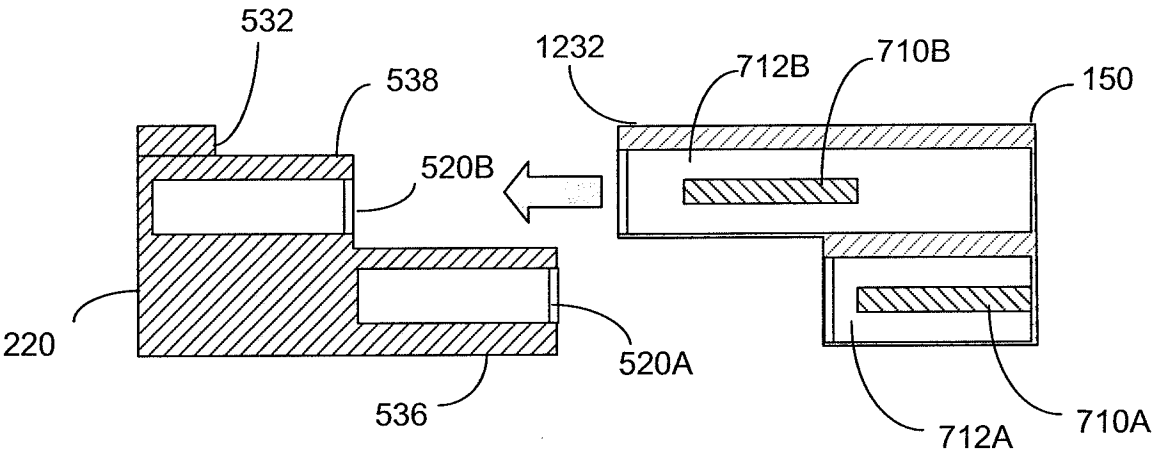
FIGS. 7A and 7B are schematic illustrations of profiles of the mating faces of a receptacle and a plug according to some embodiments of the invention.
Figure 7B:
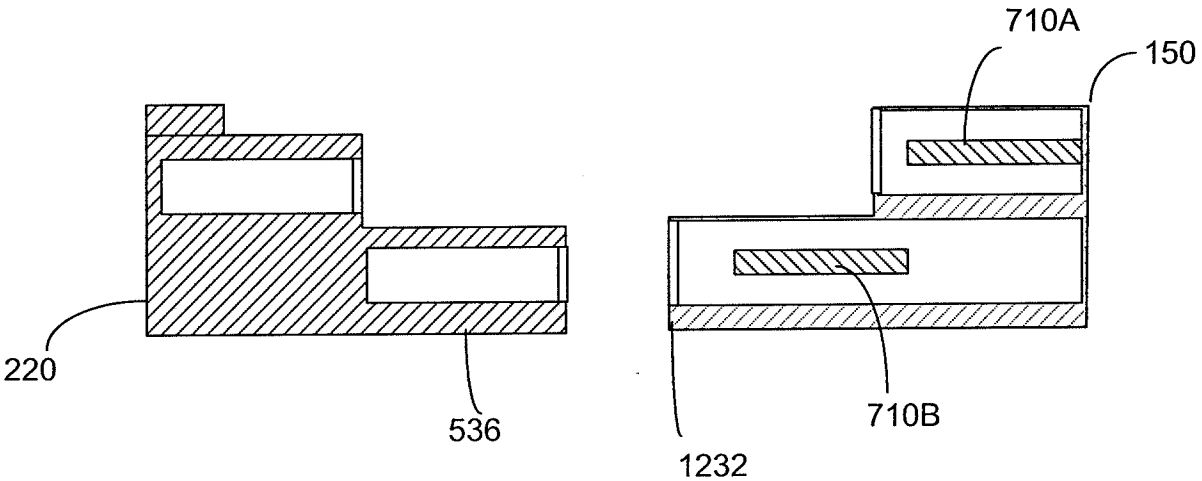

FIGS. 7A and 7B illustrate the manner in which an irregular profile of mating face 540 may allow mating between a plug and receptacle 220 in some orientations, but block mating between receptacle 220 and a plug when the plug is in other orientations. FIG. 7A illustrates that in profile, receptacle 220 has a generally L-shape, with portion 536 forming a lower horizontal portion of the L. Plug 150 has a similarly L-shaped profile formed by segments 712A and 712B. Though, when positioned for mating with receptacle 220, the L-shaped profile of plug 150 is inverted with respect to that of receptacle 220. As a result, mating end 1232 of plug 150 may slide over housing portion 538 until it abuts wall 532. In this configuration, planar member 710B may enter cavity 520B. Likewise, planar member 710A may enter cavity 520A.

In plug 150, planar members 710A and 710B have mating contact portions of conductive elements that carry signals through plug 150. The mating contact portions on planar members 710A and 710B may be positioned to align with the mating contact portions of the conductive elements carrying signals through receptacle 220. Accordingly, if planar members 710A and 710B enter cavities 520A and 520B, respectively, the conductive elements in plug 150 made with respective conductive elements in receptacle 220.

FIG. 7B shows that if plug 150 is positioned with an alternative orientation, plug 150 will not mate with receptacle 220. Specifically, mating end 1232 will abut portion 536, stopping motion of plug 150 towards receptacle 220. As a result, planar member 710B does not enter cavity 520A. Likewise, planar member 710A does not enter cavity 520B. By blocking planar members 710A and 710B from entering cavities 520A and 520B, improper connections between the conductive elements within plug 150 and receptacle 220 are prevented.

Figure 11:
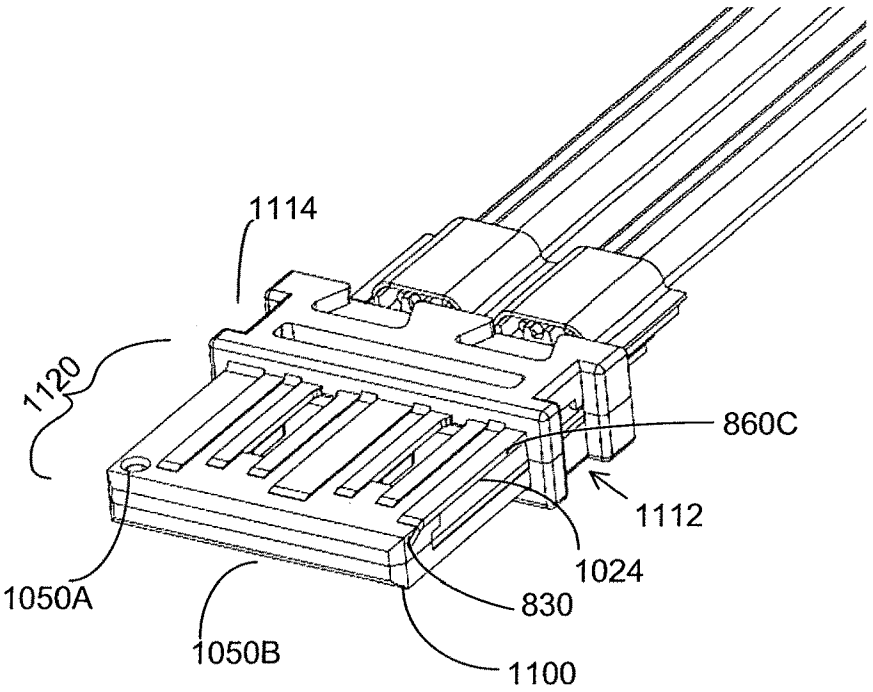
FIG. 11 is a sketch of a wafer sub-assembly according to some embodiments of the invention.

FIGS. 8, 9, 10 and 11 illustrate a technique for forming the planar members, such as 710A and 710B within plug 150. Each of the planar members 710A and 710B may be constructed in the same way. In the example embodiment of FIGS. 8-11, each of the planar members is a wafer sub-assembly 1100 (FIG. 11). Though, any suitable construction techniques may be used.

Figure 8:
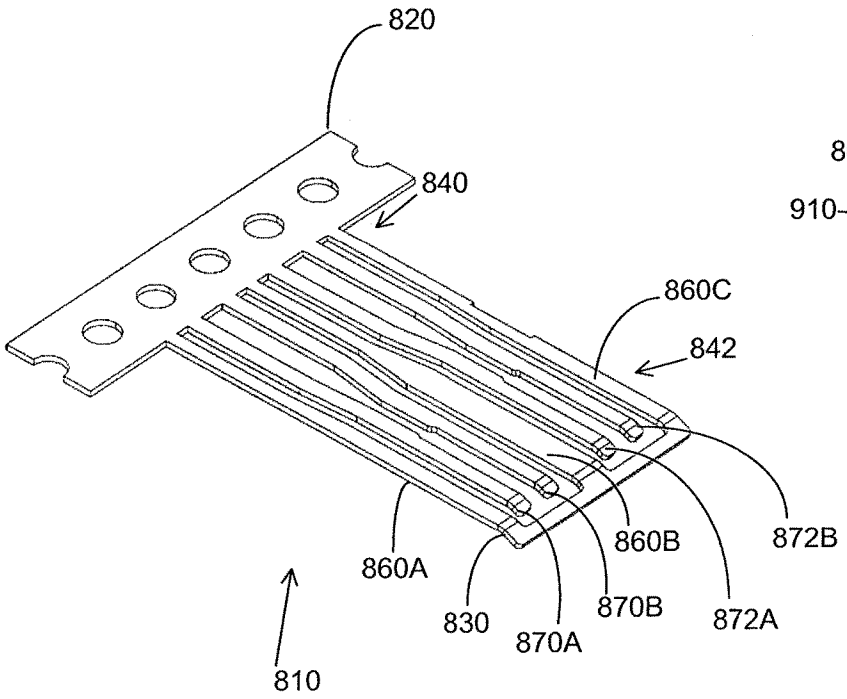
FIG. 8 is a sketch of a lead frame of a plug according to some embodiments of the invention.

In the embodiment illustrated, each wafer sub-assembly is formed from two wafers, each of which includes a lead frame held within an insulative housing. FIG. 8 illustrates a lead frame suitable for use in forming a wafer of a wafer sub-assembly 1100. In the example of FIG. 8, each wafer includes conductive elements configured to form two differential signal pairs. Conductive elements forming ground conductors may be interspersed with the signal pairs. As a specific example, FIG. 8 shows a lead frame 810 including conductive elements 870A and 870B, forming a first differential signal pair. Conductive elements 872A and 872B form a second differential signal pair. In lead frame 810, conductive elements 860A, 860B and 860C may be designated as ground conductors. With this configuration, each of the differential signal pairs is positioned along a column between two adjacent ground conductors.

In this example of FIG. 8, lead frame 810 includes a conductive segment 830 interconnecting conductive elements 860A, 860B and 860C. In this configuration, conductive segment 830 electrically interconnects the ground conductors in a wafer that may be used in forming a wafer sub-assembly. The inventors have recognized and appreciated that connecting the distal ends of the ground conductors may improve the integrity with which signals propagate through interconnection system 100.

Lead frame 810 may be formed from materials of the type known in the art for forming conductive elements within an electrical connector. For example, lead frame 810 may be formed of a copper alloy. All or portions of the conductive elements may be coated. For example, the portions of the conductive elements in region 840 form tails for the conductive elements. The portions of the conductive elements in region 840 may be coated with nickel, tin or other solder wettable material to facilitate attachment of other conductors in region 840 as part of attaching a wafer sub-assembly to a cable. Portions of conductive elements in region 842, forming the mating contact portions of the conductive elements, may be coated with gold or other malleable conductive material resistant to oxidation. Such coatings may be applied using techniques as are known in the art.

In forming lead frame 810, a blanking operation may be used to provide conductive elements having a desired outline. As part of the blanking operation, a carrier strip 820 may be retained to facilitate handling of lead frame 810. Once the conductive elements are embedded within insulative housing, carrier strip 820 may be separated from the conductive elements. Once conductive elements are blanked from a sheet of metal, the conductive elements may be shaped in a forming operation. In the embodiment illustrated in FIG. 8, the conductive elements are generally planar. However, the forward mating ends of the conductive elements are tapered in the downward direction in the orientation illustrated in FIG. 8. Conductive segment 830 is formed to extend below these tapered portions of the conductive elements. This positioning embeds conductive segment 830 and the distal ends of the conductive elements 860A, 870A, 870B, 860B, 872A, 872B and 860C in an insulative housing 910 (FIG. 9) when lead frame 810 is incorporated into a wafer 900.

Figure 9:
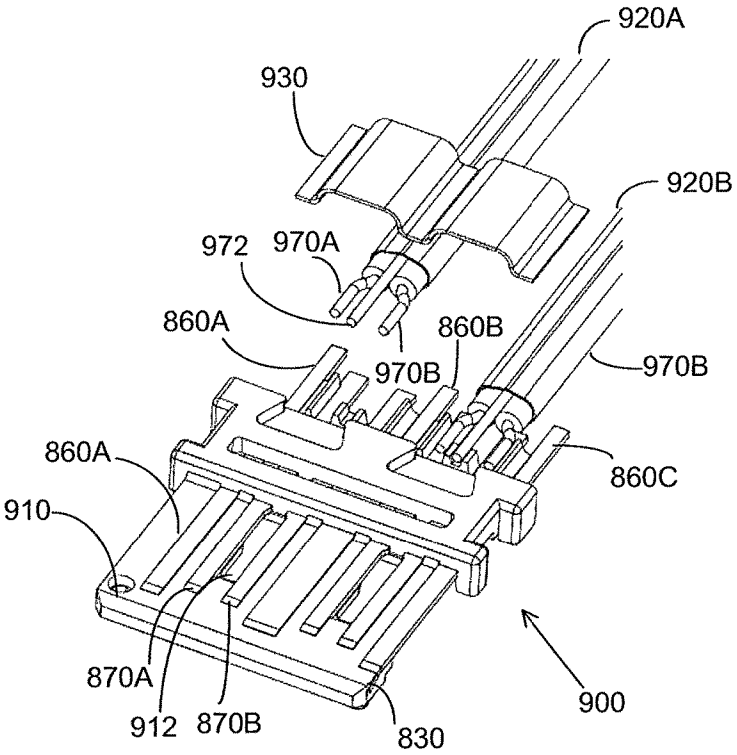
FIG. 9 is a partially exploded view of a plug sub-assembly according to some embodiments of the invention.

FIG. 9 illustrates an example of a wafer 900 formed by embedding lead frame 810 in an insulative housing 910. Any suitable technique may be used to embed lead frame 810 within housing 910. For example, an over molding process as is known in the art may be used to form wafer 900. The over molding may be performed using an insulative material of type described above for forming receptacle housing 510, or any other suitable material.

In the configuration illustrated in FIG. 9, though the distal tips of the conductive elements of lead frame 810 are embedded within insulative housing 910, surfaces of the conductive elements within region 842 (FIG. 8) are exposed FIG. in a surface of housing 910. The exposed portions form mating contact portions of the conductive elements in plug 150. Here, the mating contact portions are shaped as conductive pads. Housing 910 may be formed with one or more cavities. For example, such as cavity 912 may be formed between portions of conductive elements that form a differential pair. As shown, cavity 912 separates conductive elements 870A and 870B.

Contact tails in region 840 of lead frame 810 are also exposed. In the configuration illustrated in FIG. 9, the contact tails extend from a rearward portion of housing 910. In this configuration, the contact tails are positioned for attachment to cables. In this example, two cables, cables 920A and 920B are attached to conductive elements within wafer 900. Each of the cables 920A and 920B contains a pair of signal wires, of which signal wires 970A and 970B numbered in FIG. 9. Each of the signal wires may be attached to a contact tail of a signal conductor in lead frame 810. In the embodiment illustrated in FIG. 9 signal wire 970A may be attached to a tail of conductive element 870A. Likewise, wire 970B may be attached to a tail of conductive element 870B. Wires associated with cable 920B may similarly be attached to tails of conductive elements 872A and 872B. The wires may be attached to the tails in any suitable way. The wires, for example, may be welded, brazed or soldered to the contact tails. Though any suitable attachment technique may be used.

Each of the cables 920A and 920B may also include a drain wire, of which drain wire 972 is numbered. Drain wire 972 may be electrically coupled to one or more of the tails of the ground conductors. In the embodiment illustrated, drain wire 972 is indirectly coupled to tails of conductive elements 860A, 860B and 860C through corrugated plate 930.

Corrugated plate 930 is shaped to make contact with tails of ground conductors in wafer 900. The corrugations, though, prevent contact with signal wires or signal tails. Corrugated plate 930 may be welded to tails of conductive elements 860A, 860B and 860C and may have a portion adjacent drain wire 972. Placing plate 930 in proximity to drain wire 972 may provide electrical coupling through capacitive means between drain wire 972 and plate 930 such that an adequate electrical connection is formed between drain wire 972 and one or more of the tails of the ground conductors to which plate 930 is attached. Alternatively, drain wire 972 may be connected to plate 930, such as by brazing or soldering. Though, in other embodiments, a direct connection may be formed between a drain wire, such as drain wire 972, and a ground conductor. Such a direct connection may be formed, for example, by welding.

Figure 10:
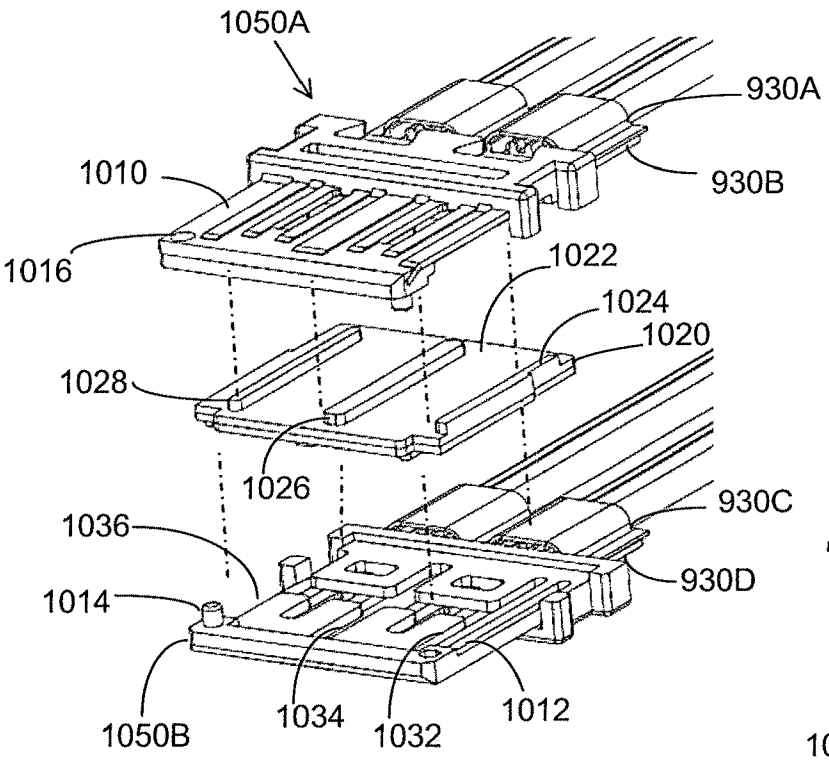
FIG. 10 is a sketch, partially exploded, of a portion of a wafer according to some embodiments of the invention.

In addition to providing electrical coupling for drain wires, such as drain wire 972, and a corresponding drain wire (not numbered) in cable 920B, corrugated plate 930 may provide shielding in the vicinity of the contact tails for the conductive elements within wafer 900. Corrugated plate 930 provides such shielding for radiation emanating from or incident on signal wires, such as 970A and 970B, from an upper direction in the orientation illustrated in FIG. 9. A similar corrugated plate may be attached from below, effectively providing shielding on both sides of signal wires and contact tails. FIG. 10 shows two such wafers, wafers 1050A and 1050B, each with two corrugated plates welded to tails of ground conductors to encircle the signal conductors by the plates.

Corrugated plate 930 may be formed of a metal or any other suitable conductive material, which may be stamped and formed into a suitable shape.

In the example of FIG. 10, wafer 1050 includes corrugated plates 930A and 930B. Wafer 1050B includes corrugated plates 930C and 930D.

FIG. 10 is a partially exploded view of wafer assembly 1100. In the example of FIG. 10, wafer assembly 1100 is formed from two wafers 1050A and 1050B. In this example, each of the wafers 1050A and 1050B has the same shape. However, wafer 1050B has an opposite orientation from wafer 1050A. As can be seen in FIG. 10, the mating contact portions of the conductive elements in wafer 1050A are exposed in an outwardly facing surface 1010. Outwardly facing surface 1010 of wafer 1050A has an upward orientation in the example of FIG. 10. Wafer 1050B has a similar outwardly facing surface, but it has a downwardly facing direction in the configuration of FIG. 10 and therefore is not visible. Rather, an inwardly facing surface 1012, of wafer 105B, which has an upward orientation in FIG. 10, is visible. Wafer 1050A has a corresponding inwardly facing surface, which has a downwardly facing direction in FIG. 10 and therefore is not visible.

In assembling wafer sub-assembly 1100, wafers 1050A and 1050B are aligned with their inwardly facing surfaces, facing each other. Between the inwardly facing surfaces, a lossy member 1020 may be included. Lossy member 1020 may be formed of a suitable lossy material, including lossy material having properties as described above in connection with the inserts of the receptacle 220. In the embodiment illustrated, lossy member 1020 is formed of a material that is partially conductive. In this embodiment, lossy member 1020 may be electrically isolated from signal conductors within wafers 1050A and 1050B by the insulative housings of those wafers.

In the embodiment illustrated, however, lossy member 1020 may be electrically coupled to ground conductors within wafers 1050A and 1050B. This coupling may be provided through projections from surfaces of lossy member 1020. In FIG. 10, upwardly facing surface 1022 of lossy member 1020 is visible. Projections 1024, 1026 and 1028 are formed in surface 1022. Projections 1024, 1026 and 1028 are aligned with the ground conductors in wafer 1050A. Similar projections may extend from a lower surface (not visible in FIG. 10) of lossy member 1020. Those projections may be positioned to align with ground conductors in wafer 1050B. To facilitate electrical connection between the projections of lossy member 1010 and the ground conductors, the insulative housings of wafers 1050A and 1050B may be formed with openings aligned with the ground conductors. In FIG. 10, openings 1032, 1034 and 1036 are visible in inwardly facing surface 1012 of wafer 1050B. The inwardly facing surface of wafer 1050A may have similar openings to receive projections 1024, 1026 and 1028.

In some embodiments, the openings, such as openings 1032, 1034 and 1036 may expose a subset of the conductive elements in wafer 1050B through inwardly facing surface 1012. That subset may include some or all of the ground conductors in wafers 1050B. As a result, lossy member 1020 may provide access to the ground conductors in wafer 1050B. Similar openings in the inwardly facing surface of wafer 1050A may provide lossy coupling between the ground conductors in wafer 1050A to provide lossy coupling between that subset of the conductive elements in wafer 1050A. Such a coupling may improve signal integrity, particularly of high frequency signals propagating through the signal conductors of wafers 1050A and 1050B.

In some embodiments, projections, such as projections 1024, 1026 and 1028 may be electrically coupled to ground conductors by making direct contact to those conductive elements. However, in other embodiments, coupling between lossy member 1020 and the ground conductors may be capacitive such that merely positioning the projections in close proximity to the ground conductors may achieve sufficient electrical coupling.

A wafer assembly 1100 may be formed by aligning wafers 1050A and 1050B with their inwardly facing surfaces facing towards each other and with lossy member 1020 between wafers 1050A and 1050B. Wafers 1050A and 1050B may then be secured together, holding lossy member 1020 in place. In this example, each of the wafers 1050A and 1050B is shown with attachment features that may be used to secure wafers 1050A and 1050B together. As illustrated, each of the wafers includes a post, such as post 1014 which is aligned with a hole, such as hole 1016. Post 1014 may be retained in hole 1016 such as through welding, through the use of adhesives, through an interference fit or in any other suitable way.

Regardless of the manner in which wafers 1050A and 1050B are secured, the resulting wafer sub-assembly 1100 may have the form illustrated in FIG. 11. In this view, FIG. projection 1024 contacting conductive element 860C is visible. Conductive segment 830, embedded in the housing of wafer 1050A is also visible.

With wafers 1050A and 1050B secured together, wafer sub-assembly 1100 forms a planar member 1120. As can be seen, planar member 1120 includes the conductive elements of wafer 1050A on an outwardly facing surface of wafer 1050A, facing in an upward direction in the orientation of FIG. 11. In this example, mating contact portions of the conductive elements are held in a plane defined by the upper surface. Though not visible in FIG. 11, the outwardly facing surface of wafer 1050B, which is facing in a downward direction in FIG. 11, contains contact portions of the conductive elements of wafer 1050B. Accordingly, planar member 1120 includes mating contact portions of conductive elements on both outwardly facing surfaces. Accordingly, planar member 1120 may serve the purpose of planar members 710 (FIG. 7) for insertion into a port in receptacle 220 (FIG. 2).

Wafer sub-assembly 1100 includes attachment features that allow it to be held within a shell of a plug. In the example of FIG. 11, those attachment features include attachment features 1112 and 1114. In this example, the attachment features are in the form of slots that may engage corresponding projections in a shell. Though, any suitable attachment feature may be used.

Figure 12B:
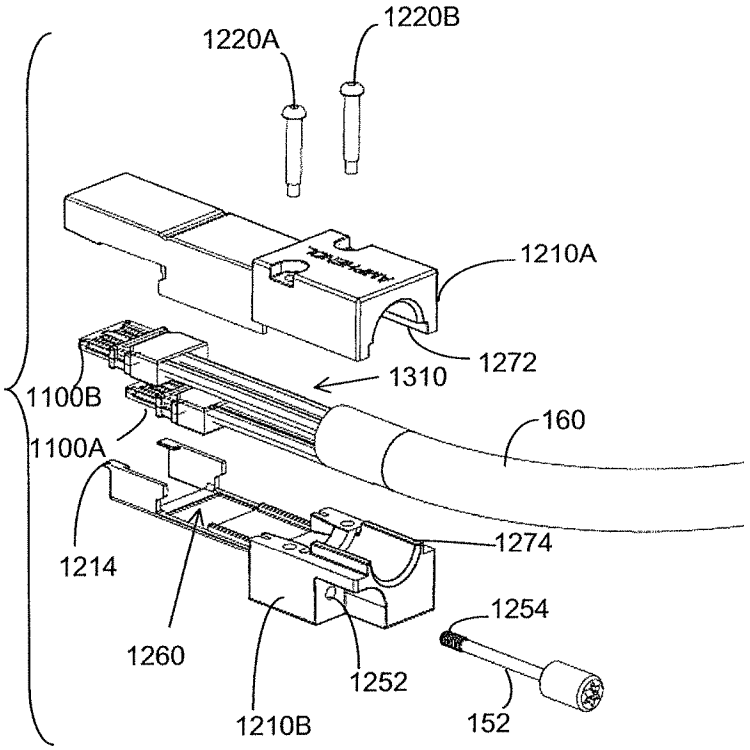
FIG. 12B is a sketch, partially exploded, of the plug of FIG. 12A.
Figure 12A:
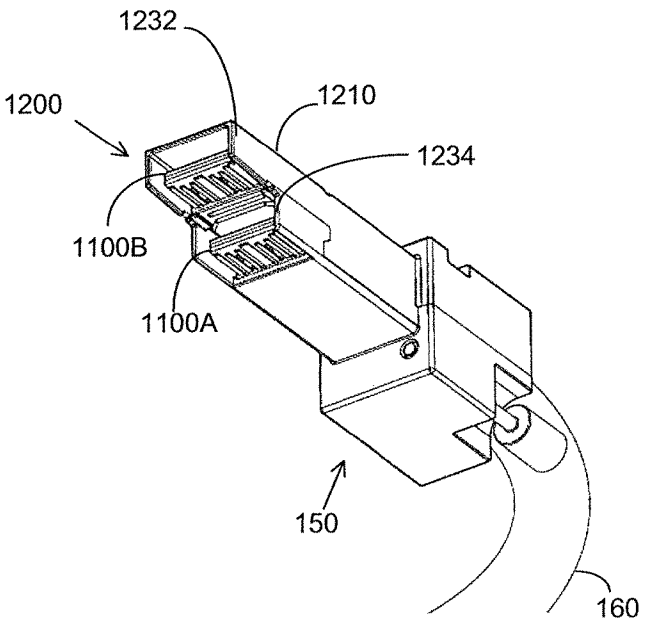
FIG. 12A is a perspective view of a plug from below, according to some embodiments of the invention.

FIG. 12A illustrates two wafer subassemblies, wafer subassemblies 1100A and 1100B, in a shell 1210 that acts as a housing for plug 150. As can be seen in the view of plug 150 presented in FIG. 12A, the planar numbers of wafer subassemblies 1100A and 1100B are aligned in parallel. Wafer subassemblies 1100A and 1100B are held within shell 1210 as such that wafer sub-assembly 1100B is closer to mating face 1200 then wafer sub-assembly 1100A. Though, wafer sub-assembly 1100B is set back from mating end 1232 such that the mating contact portions are within shell 1210.

FIG. 12A reveals the L-shaped profile of shell 1210 along mating face 1200. Here, a portion of the L-shaped profile is formed by sidewall 1234. Sidewall 1234 is set back from mating end 1232. When plug 150 is mated with a receptacle in the form of receptacle 220 (FIG. 2), sidewall 1234 may abut shoulder 534 (FIG. 5). With mating end 1232 abutting wall 532 and sidewall 1234 abutting shoulder 534, wafer sub-assembly 1100B will be positioned to enter cavity 520B and wafer sub-assembly 1100A will be positioned to enter cavity 520A. In this way, the conductive elements along the upper and lower outwardly facing surfaces of wafer 1100B may mate with columns of conductive elements 512A and 512B, respectively within port 210B of receptacle 220. Similarly, the conductive elements positioned along the upper and lower outwardly facing surfaces of wafer sub-assembly 1100A will mate with conductive elements in columns 512C and 512D, respectively, within port 210A of receptacle 220. Though, as illustrated in connection with FIG. 7, if plug 150 is inverted, mating between plug 150 and receptacle 220 will be blocked when mating end 1232 of plug 150 contacts portion 536 of the receptacle housing.

FIG. 12B illustrates an exemplary construction of shell 1210 to hold wafer subassemblies 1100A and 1100B in the desired orientation. In the example illustrated, shell 1210 is formed from two pieces, upper shell portion 1210A and lower shell portion 1210B. Shell portions 1210A and 1210B may be made of any suitable material. However, in the embodiment illustrated, shell 1210 is conductive and upper shell portion 1210A and lower shell portion 1210B are formed of a conductive material. As one example, shell portion 1210A and 1210B may be formed of metal using die casting techniques.

In the embodiment illustrated, lower shell portion 1210B is shaped to receive wafer subassemblies 1100A and 1100B in positions that will orient the planar members of the wafer subassemblies adjacent mating face 1200. Upper shell portion 1210A is shaped to be secured to lower shell portion 1210B to hold wafer subassemblies 1100A and 1100B in position. In the example of FIG. 12B, screws 1220A and 1220B may be used to hold upper shell portion 1210A to lower shell portion 1210B. Though, any suitable fastening mechanism may be used, such as rivets, instead of or in addition to screws.

Any suitable features may be used to retain wafer subassemblies 1100A and 1100B within shell 1210. As one example, FIG. 12B shows that lower shell portion 1210B contains a region 1260 shaped to receive a rear housing portion of wafer sub-assembly 1100A.

Attachment features may also be included to position wafer sub-assembly 1100B. FIG. 12B illustrates attachment features 1214, which in this example are shaped as projections that may engage complimentary attachment features, such as attachment features 1112 and 1114 of wafer subassembly 1100B. Though, the specific attachment features used is not critical to the invention and any suitable mechanism may be used to retain wafer subassemblies 1100A and 1100B within shell 1210.

Shell 1210 may serve other functions in addition to providing a housing for wafer subassemblies 1100A and 1100B. Shell 1200 may retain a fastening mechanism, such as screw 152, such that plug 150 may be secured to a receptacle assembly. Accordingly, lower shell portion 1210B may include a hole 1252 to receive screw 152. Lower shell portion 1210B may be shaped such that when screw 152 is inserted fully into hole 1252, thread 1254 may extend through hole 1252 such that it may engage a receptacle assembly. Screw 152 may be held within hole 1252 using a clip or other mechanism that allows screw 152 to rotate and slide within hole 1252, but prevents screw 152 from being fully withdrawn from hole 1252.

Shell 1210 may additionally be constructed to make electrical and mechanical connection to cable bundle 160. As illustrated in FIG. 12B, upper shell portion 1210A includes a region 1272 and lower shell portion 1210B includes a region 1274. Regions 1272 and 1274 are generally circular and are sized to receive cable bundle 160. However, the sizing is such that when upper shell portion 1210A is secured to lower shell portion 1210B, portions of cable bundle 160 will be squeezed against regions 1272 and 1274, making a desired electrical and mechanical connection between cable bundle 160 and shell 1210.

Figure 13A:
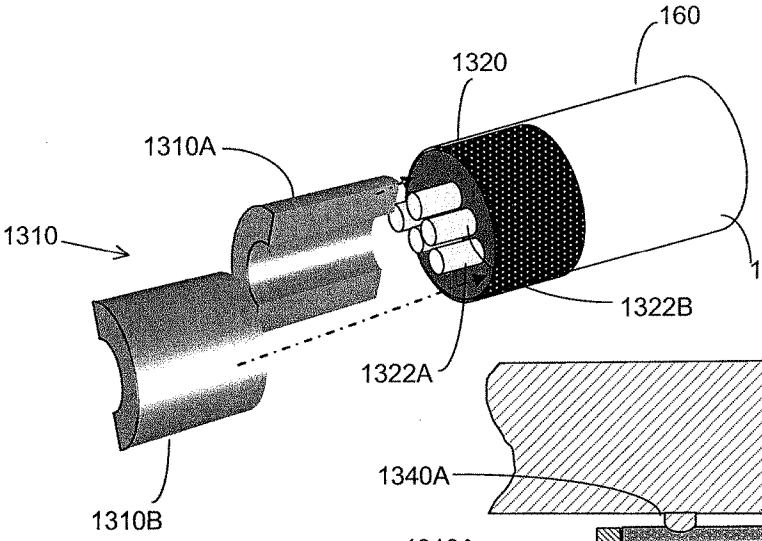
FIG. 13A is a schematic illustration of features for mounting a plug to a cable bundle according to some embodiments of the invention.
Figure 13B:
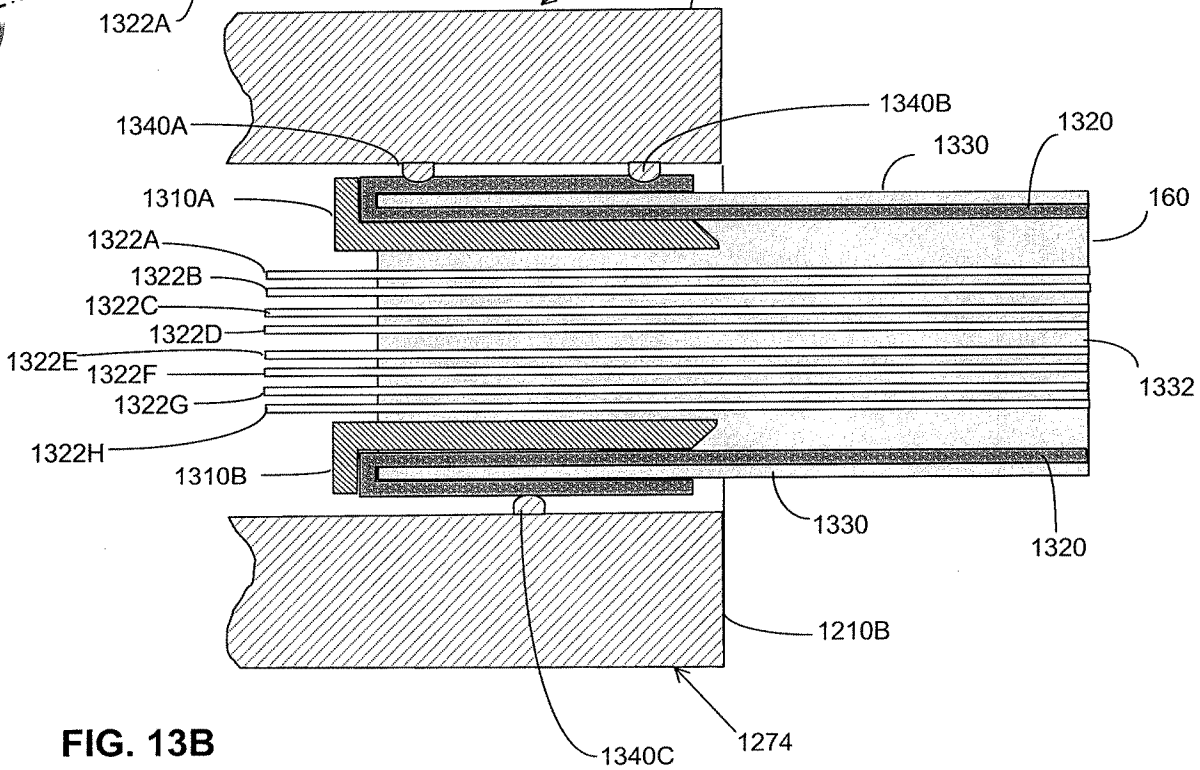
FIG. 13B is a cross-section through a portion of a plug attached to a cable bundle according to some embodiments of the invention.
Figure 14:
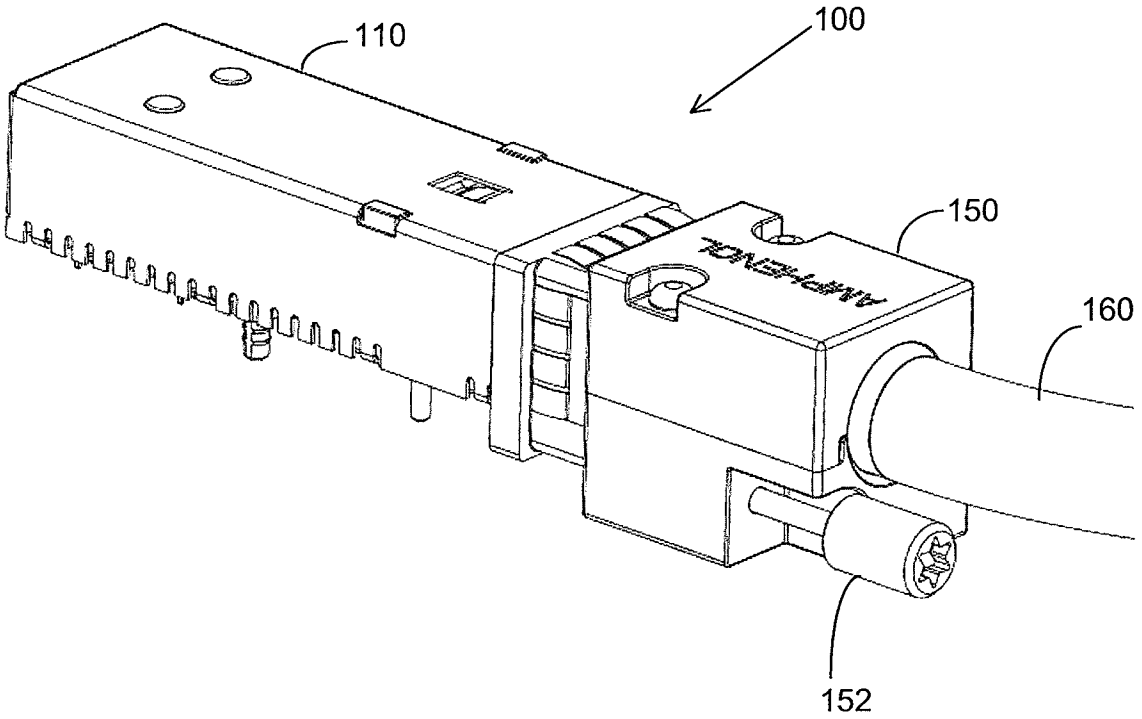
FIG. 14 is a sketch showing a plug mated with a receptacle assembly according to some embodiments of the invention.

FIGS. 13A and 13B illustrate electrical and mechanical attachment between shell 1210 and cable bundle 160. Cable bundle 160 may contain multiple cables of which cables 1322A and 1322B are numbered in FIG. 13A. As illustrated in FIG. 10, conductors from two cables are attached to the conductive elements within each wafer, such as wafers 1050A and 1050B. Accordingly, as illustrated in FIG. 11, the conductors within four cables are attached to the conductive elements within each wafer sub-assembly, such as wafer sub-assembly 1100. In a plug in the form illustrated in FIG. 12B containing two wafer subassemblies, there may be eight cables within cable bundle 160. Though, it should be appreciated that the number of cables within a cable bundle is not critical to the invention.

FIG. 13B illustrates cables 1322A . . . 1322H within cable bundle 160. Each of the cables may be held in interior portion 1332 of cable bundle 160. Further, though not shown in FIGS. 13A and 13B, each of the cables 1322A . . . 1233H may contain two signal wires, such as signal wires 970A and 970B (FIG. 9), and a drain wire, such as drain wire 972. These wires within each cable may be held within a core of a dielectric material within the cable. The cores of the cables position the wires within the cables to provide desired impedance for conveying differential signals. FIG. 13B illustrates an attachment mechanism that makes a secure electrical and mechanical connection between cable bundle 160 and shell 1200, without crushing cable bundle 160 in a way that would alter the spacing between wires in the cables 1322A . . . 1322H. In this way, the electrical properties of cables 1322A . . . , 1322H are not degraded when cable bundle 160 is attached to shell 1200.

The attachment mechanism includes a multipart ferrule attached at an end of cable bundle 160. In the example illustrated in FIGS. 13A and 13B, the multipart ferrule includes two parts, ferrule parts 1310A and 1310B. Though, it should be appreciated that a multipart ferrule may have more than two parts.

Each of the ferrule parts 1310A and 1310B may be inserted under jacket 1330 of cable bundle 160. In this example, each of the ferrule parts 1310A and 1310B is inserted under braid 1320. A portion of braid 1320 extending beyond jacket 1330 may be folded back on top of jacket 1330. The portion of cable bundle 160 containing ferrule 1310 may be positioned between shell portions 1210A and 1210B in regions 1272 and 1274. When shell portions 1210A and 1210B are secured together, cable bundle 160 will be secured between shell portions 1210A and 1210B.

To increase the force asserted by shell portions 1210A and 1210B against cable bundle 160, projections may be included in shell portions 1210A. FIG. 13B illustrates projections 1340A, 1340B and 1340C. In the illustrated embodiment in projections 1340A and 1340B are semicircular ribs lining an interior surface of shell portion 1210A in region 1272. The semicircular ribs extend in a direction perpendicular to the elongated axis of cable bundle 160. Similarly, projection 1340C may be formed as a semicircular rib in lower shell portion 1210B.

When shell portions 1210A and 1210B are secured together, braid 1320 and jacket 1330 will be pinched between ferrule 1310 and projections 1340A, 1340B, and 1340C. Though ferrule 1310 is in multiple pieces, the pieces collectively define a closed path encircling cables 1322A . . . , 1322H. As a result, even though shell portions 1210A and 1210B press against ferrule halves 1310A and 1310B, the cores within cables 1322A . . . , 1322H are not appreciably compressed. As a result, a strong mechanical attachment is formed without altering the electrical properties of cables 1322A . . . , 1322H.

Additionally, because projections 1340A, 1340B, and 1340C directly contact braid 1320, a good electrical connection is formed between braid 1320 and shell 1210.

Such strong electrical and mechanical connections may be formed using simple assembly techniques. The multiple piece nature of ferrule 1310 allows the ferrule to be attached to cable bundle 160 after wafer subassemblies 1100A and 1100B have been attached to the cables within cable bundle 160. For example, as illustrated in FIG. 13A, the end of cable bundle 160 may be prepared for a plug 150 to be attached by stripping portions of jacket 1330 to expose lengths of cables 1310 (FIG. 12B). Each of the cables may then be stripped to reveal wires, such as 970A and 970B (FIG. 9). These wires may then be brazed or otherwise attached tails extending from a wafer. The wafers may then be attached to form wafer subassemblies. With the wafer subassemblies attached to the ends of cables 1322A . . . , 1322H, jacket 1330 and braid 1320 may be trimmed to appropriate lengths to fit within regions 1272 and 1274. Once the elements of cable bundle 160 are cut to the appropriate length, ferrule halves 1310A and 1310B may be inserted in cable bundle 160.

With plug 150 attached to cable bundle 160, plug 150 may be inserted into receptacle assembly 110. In this way, electrical connections may be formed between signal wires within cable bundle 160 and conductive traces within a printed circuit board, such as printed circuit board 120 to which receptacle assembly 110 is attached. To secure plug 150 in place, screw 150 may be engaged.

Figure 15:
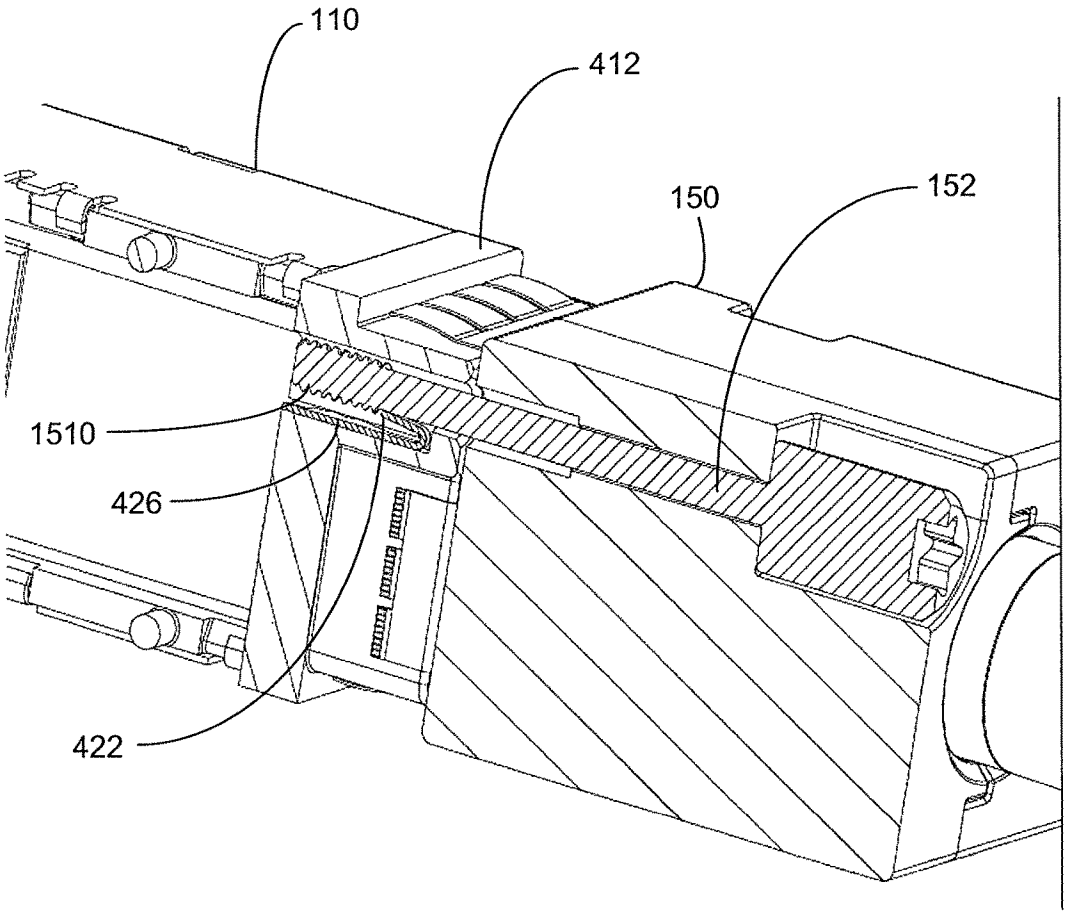
FIG. 15 is a cross-section through a portion of a plug secured to a receptacle assembly according some embodiments of the invention.

FIG. 15 shows in cross section plug 150 secured to receptacle assembly 110 via screw 152. In the configuration illustrated, screw 152 had been pressed into hole 116 (FIG. 1). Thread 1510 at a distal end of screw 152 has slid past compliant member 422 such that compliant member 422 engages thread 1510. In this state, screw 152 is prevented by the locking action of compliant member 422 against thread 1510 from being pulled out of hole 116. However, screw 152 may be removed by rotating screw 152 such that thread 1510 slides along compliant member 422.

Having thus described several aspects of at least one embodiment of this invention, it is to be appreciated various alterations, modifications, and improvements will readily occur to those skilled in the art.

For example, the techniques described herein need not all be used together. These techniques may be used in any suitable combination to provide desired connector performance.

As another example of possible variations, although inventive aspects are shown and described with reference to cable connectors, some or all of these techniques may be applied to connectors of other types, such as backplane connectors.

Also, though embodiments of connectors assembled from wafers are described above, in other embodiments connectors may be assembled from wafers without first forming wafers. As one example connectors may be assembled by inserting multiple columns of conductive members into a housing.

In the embodiments illustrated, some conductive elements are designated as forming differential pairs of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. For example, a pair of signal conductors may have a differential mode impedance of between 75 Ohms and 100 Ohms. As a specific example, a signal pair may have an impedance of 85 Ohms +/−10% or 100 Ohms +/−10%. A ground conductor may have a higher inductance than a signal conductor, which may lead to an impedance outside this range. As yet another example, a connector in which a column containing pairs of high speed signal conductors and adjacent ground conductors was described. It is not a requirement that every signal conductor in a column be part of a pair or that every signal conductor be a high speed signal conductor. In some embodiments, columns may contain lower speed signal conductors intermixed with high speed signal conductors.

As another example, certain features of connectors were described relative to a "front" face. The front face of a connector may be regarded as surfaces of the connector facing in the direction from which a mating connector is inserted. However, it should be recognized that terms such as "front" and "rear" are intended to differentiate surfaces from one another and may have different meanings in electronic assemblies in different forms. Likewise, terms such as "upper" and "lower" are intended to differentiate features based on their position relative to a printed circuit board or to portions of a connector adapted for attachment to a printed circuit board. Such terms as "upper" and "lower" do not imply an absolute orientation relative to an inertial reference system or other fixed frame of reference.

As a further example, hole 116, which receives a fastening member attached to plug 150, is shown to be formed as part of front housing portion 114 of the receptacle assembly. Such a hole may be incorporated into the receptacle assembly in any suitable way, including being formed in a panel incorporating the receptacle assembly.

In accordance with the foregoing, some novel aspects of the present application are summarized below.

According to an aspect of the present application, there is provided a connector comprising: a shell; and at least one sub-assembly held within the shell, each of the at least one sub-assemblies comprising: a first housing having a first outer surface and a first inner surface; a first plurality of conductive elements held by the first housing, each of the conductive elements of the first plurality comprising a mating contact portion adjacent a first end of the conductive element and a tail adjacent a second end of the conductive element; a second housing having a second outer surface and a second inner surface; a second plurality of conductive elements held by the second housing, each of the conductive elements of the second plurality comprising a mating contact portion adjacent a first end of the conductive element and a tail adjacent a second end of the conductive element; and a lossy member disposed between the first housing and the second housing, the planar member comprising an electrically lossy material; wherein the first housing and the second housing are held within the shell with the first inner surface facing the second inner surface.

In some embodiments, mating contact portions of the conductive elements of the first plurality of conductive elements are exposed in the first outer surface; and mating contact portions of the conductive elements of the second plurality of conductive elements are exposed in the second outer surface.

In some embodiments, for each conductive element of a first subset of the first plurality of conductive elements, a portion of the conductive element is exposed through the first inner surface; and for each conductive element of a second subset of the second plurality of conductive elements, a portion of the conductive element is exposed through the second inner surface.

In some embodiments, the lossy member comprises a first surface and a second surface, the first surface being positioned adjacent the first inner surface and the second surface being positioned adjacent the second inner surface; the first surface of the lossy member comprises a first plurality of projections, each projection of the first plurality of projections being coupled to a conductive element of the first subset; and the second surface of the lossy member comprises a second plurality of projections, each projection of the second plurality of projections being coupled to a conductive element of the second subset.

In some embodiments, the first plurality of conductive elements comprises conductive elements disposed in a plurality of pairs of conductive elements; and the first subset of the first plurality of conductive elements comprises conductive elements each of which is disposed adjacent a pair of the plurality of pairs.

In some embodiments, conductive elements disposed in the plurality of pairs have a first width; and conductive elements within the first subset of the plurality of conductive elements have a width greater than the first width.

In some embodiments, the plurality of pairs is a first plurality of pairs; the second plurality of conductive elements comprises conductive elements disposed in a second plurality of pairs of conductive elements; and the second subset of the second plurality of conductive elements comprises conductive elements each of which is disposed adjacent a pair of the second plurality of pairs.

In some embodiments, conductive elements disposed in the second plurality of pairs have the first width; and conductive elements within the second subset of the plurality of conductive elements are wider than the first width.

In some embodiments, the connector further comprises: a fastening mechanism holding the first housing to the second housing.

In some embodiments, the fastening mechanism comprises a post on the first housing sized to engage an opening within the second housing.

In some embodiments, the shell comprises a mating end; and the at least one sub-assembly comprises a first sub-assembly and a second assembly, the first sub-assembly and the second sub-assembly being positioned in parallel planes with the first sub-assembly closer to the mating end than the second sub-assembly.

In some embodiments, the connector further comprises: a first conductive segment interconnecting a plurality of conductive elements in the first subset; and a second conductive segment interconnecting a plurality of conductive elements in the second subset.

In some embodiments, the first conductive segment is embedded within the first housing adjacent mating contact portions of the conductive elements of the first plurality of conductive elements; and the second conductive segment is embedded within the second housing adjacent mating contact portions of the conductive elements of the second plurality of conductive elements.

According to an aspect of the present application, there is provided a connector configured as a plug adapted for engaging a receptacle, the plug comprising: a shell; and a plurality of sub-assemblies held within the shell, each of the plurality of sub-assemblies comprising: a first insulative housing having a first outer surface and a first inner surface, the first insulative housing having a plurality of first openings therein; a first plurality of conductive elements held by the first insulative housing, each conductive element of a first subset of the first plurality of conductive elements having a portion positioned in a respective first opening; a second housing having a second outer surface and a second inner surface, the second insulative housing having a plurality of second openings therein; a second plurality of conductive elements held by the second insulative housing, each conductive element of a second subset of the second plurality of conductive elements having a portion positioned in a respective second opening; and a lossy member disposed between the first housing and the second housing, the lossy member being comprised of an electrically lossy material, and the lossy member comprising: a first plurality of projections, each of the first plurality of projections extending into a respective first opening and being electrically coupled within the first opening to a respective conductive element of the first subset; and a second plurality of projections, each of the second plurality of projections extending into a respective second opening and being electrically coupled within the second opening to a respective conductive element of the second subset.

In some embodiments, the lossy member comprises a unitary planar member.

In some embodiments, the plug further comprises: a first conductive segment interconnecting a plurality of conductive elements in the first subset, the first conductive segment being embedded in the first housing; and a second conductive segment interconnecting a plurality of conductive elements in the second subset, the second conductive segment being embedded in the second housing.

According to an aspect of the present application, there is provided a method of manufacturing a plug, the method comprising: attaching each of a first plurality of conductors of a cable to a respective cable attachment end of a conductive element held in a first insulative housing; attaching each of a second plurality of conductors of a cable to a respective cable attachment end of a conductive element held in a second insulative housing; placing a lossy member between the first housing and the second housing; securing the first housing to the second housing to form a sub-assembly; and inserting the sub-assembly into a shell.

In some embodiments, the method further comprises: molding the first insulative housing over a first lead frame, the first lead frame being comprised of the first plurality of conductive elements; wherein: the first lead frame comprises a first conductive segment interconnecting a first subset of the first plurality of conductive elements; and the molding the first insulative housing comprises encasing the first conductive segment within the first insulative housing.

In some embodiments, the method further comprises: molding the second insulative housing over a second lead frame, the second lead frame being comprised of the second plurality of conductive elements, wherein: the second lead frame comprises a second conductive segment interconnecting a second subset of the second plurality of conductive elements; and the molding the second insulative housing comprises encasing the second conductive segment within the second insulative housing.

According to an aspect of the present application, there is provided a plug adapted for engaging a receptacle, the plug comprising: a shell having an opening therein; and a plurality of sub-assemblies held within the shell, each of the plurality of sub-assemblies comprising: an insulative housing; a plurality of conductive elements held by the housing, each conductive element of the plurality of conductive elements comprising an exposed mating contact portion adjacent a first end of the conductive element; and a conductive segment interconnecting first ends of a first subset of conductive elements of the plurality of conductive elements, the first conductive segment being embedded within the insulative housing adjacent mating contact portions of the conductive elements of the first plurality of conductive elements.

In some embodiments, the plurality of conductive elements is comprised of a second subset of conductive elements, the conductive elements in the second sub-set being disposed in a plurality of pairs with a conductive element in the first subset being between adjacent pairs of the plurality of pairs.

In some embodiments, the conductive elements in the second subset are of equal width and at least one of the conductive elements in the first subset is wider than conductive elements in the second subset.

In some embodiments, the second subset consists of a first pair and a second pair and a conductive element of the first subset of conductive elements disposed between the first pair and the second pair is wider than the conductive elements of the second subset.

In some embodiments, the plurality of conductive elements are disposed in a column, with a conductive element of the first subset disposed on each end of the column being narrower than the conductive element between the first pair and the second pair.

According to an aspect of the present application, there is provided a plug, in combination with a cable bundle, wherein: the shell comprises a first portion and a second portion; the cable comprises an interior portion, an outer jacket and a conductive braid between the interior and the outer jacket; the combination comprises a ferrule between the braid and the interior portion adjacent an end of the cable; and the first portion and the second portion of the shell are held together such that the outer jacket is secured between the shell and the ferrule.

In some embodiments, a portion of the braid extends beyond the outer jacket at the end of the cable and folds over the outer jacket such that the portion of the braid is secured between the shell and the ferrule.

In some embodiments, the shell is comprised of a conductive material and the shell is electrically connected to the braid.

In some embodiments, the shell comprises a plurality of projections, each of the projections deforming the braid and outer jacket.

In some embodiments, the plurality of projections are offset with respect to each other along an axis of the cable.

In some embodiments, the ferrule comprises two pieces.

According to an aspect of the present application, there is provided a plug adapted for engaging a receptacle, the plug comprising: a shell; and at least one sub-assembly held within the shell, each of the at least one sub-assemblies comprising: a first housing; a first plurality of conductive elements held by the first housing, each of the conductive elements of the first plurality comprising a mating contact portion adjacent a first end of the conductive element and a cable attachment portion adjacent a second end of the conductive element; a second housing; a second plurality of conductive elements held by the second housing, each of the conductive elements of the second plurality comprising a mating contact portion adjacent a first end of the conductive element and a cable attachment portion adjacent a second end of the conductive element; a first conductive segment interconnecting a plurality of conductive elements of the first plurality of conductive elements, the first conductive segment is embedded within the first housing adjacent mating contact portions of the conductive elements of the first plurality of conductive elements; and a second conductive segment interconnecting a plurality of conductive elements of the second plurality of conductive elements, the second conductive segment is embedded within the second housing adjacent mating contact portions of the conductive elements of the second plurality of conductive elements.

In some embodiments, the first housing has a first outer surface and a first inner surface; mating contact portions of conductive elements of the first plurality of conductive elements are exposed in the first outer surface; the second housing has a second outer surface and a second inner surface; mating contact portions of conductive elements of the second plurality of conductive elements are exposed in the second outer surface; and the first housing and the second housing are held within the shell with the first inner surface facing the second inner surface.

In some embodiments, the plug further comprises a lossy member between the first housing and the second housing.

In some embodiments, the sub-assembly comprises a forward mating edge; the first conductive segment is embedded in the first housing along the forward mating edge; the second conductive segment is embedded in the second housing along the forward mating edge.

According to an aspect of the present application, there is provided a plug, in combination with a cable bundle, wherein: the shell comprises a first portion and a second portion; the cable comprises an interior portion, an outer jacket and a conductive braid between the interior portion and the outer jacket, and a plurality of conductors, each of the conductors being attached to a cable attachment portion of a conductive element of the first plurality of conductive elements or the second plurality of conductive elements; the combination comprises a ferrule between the braid and the interior portion adjacent an end of the cable bundle; and the first portion and the second portion of the shell are held together, whereby the outer jacket is secured in the shell by a force between the shell and the ferrule.

In some embodiments, the shell comprises a plurality of projections adjacent the end of the cable, each of the projections deforming the braid and outer jacket.

In some embodiments, the ferrule comprises a plurality of segments that form a tubular ferrule.

According to an aspect of the present application, there is provided a sub-assembly adapted for use in a plug, the sub-assembly comprising: a housing having a first outer surface and a second outer surface; a first plurality of conductive elements held by the housing, each of the conductive elements of the first plurality comprising a mating contact portion adjacent a first end of the conductive element and a cable attachment portion adjacent a second end of the conductive element, the mating contact portion being exposed in the first outer surface; a second plurality of conductive elements held by the housing, each of the conductive elements of the second plurality comprising a mating contact portion adjacent a first end of the conductive element and a cable attachment portion adjacent a second end of the conductive element, the mating contact portion being exposed in the second outer surface; a first conductive segment interconnecting the first ends of a plurality of conductive elements of the first plurality of conductive elements, the first conductive segment being embedded within the first housing; and a second conductive segment interconnecting the first ends of a plurality of conductive elements of the second plurality of conductive elements, the second conductive segment being embedded within the second housing.

In some embodiments, the first plurality of conductive elements is disposed in a repeating pattern of a conductive element interconnected with the first conductive segment and a pair of conductive elements separate from the first conductive segment; and the second plurality of conductive elements is disposed in a repeating pattern of a conductive element interconnected with the second conductive segment and a pair of conductive elements separate from the second conductive segment.

According to an aspect of the present application, there is provided a receptacle assembly comprising: a housing having a mating face; a plug-receiving port within the mating face; a plurality of conductive elements disposed within the housing, each of the conductive elements comprising a mating contact portion within the port; a hole in the mating face, the hole being bounded by at least one wall; and a compliant member within the hole, the compliant member comprising a segment, the segment being adjacent the wall at a first location and extending toward a centerline of the hole at a second location, the first location being closer to the mating face than the second location.

In some embodiments, the segment of the compliant member is a first segment; and the compliant member comprises a second segment.

In some embodiments, the compliant member comprises a metal strip bent to form the first segment and the second segment.

In some embodiments, the compliant member comprises a metal strip.

In some embodiments, the compliant member is a J-shaped member.

In some embodiments, the receptacle comprises at least two ports in the mating face.

According to an aspect of the present application, there is provided a receptacle assembly, in combination with a plug, the plug comprising: a shell; a planar member disposed within the shell, the planar member comprising plurality of conductive elements, each conductive element having a mating contact portion, a screw comprising a thread, wherein: the planar member of the plug is positioned within the plug-receiving port to align the mating contact portions of the conductive elements within the plug with the mating contact portion of the conductive elements within the receptacle assembly; the segment of the complaint member has a distal end; and the screw is inserted in the hole with the distal end of the segment engaging the thread of the screw.

In some embodiments, the combination further comprises a cable and the plug is attached to the cable.

In some embodiments, the combination further comprises a printed circuit board mounted adjacent a panel of an electronic device, the panel comprising an opening and the plug-receiving port being positioned in the opening.

According to an aspect of the present application, there is provided a method of operating an interconnection system comprising a receptacle and a plug, the method comprising: inserting the plug into a port in the receptacle; securing the plug to the receptacle by pressing a screw coupled to the plug into a hole in the receptacle; and releasing the plug from the receptacle by rotating the screw.

In some embodiments, the receptacle comprises a retaining member and pressing the screw into the hole comprises deflecting the retaining member.

In some embodiments, the screw comprises a thread; the retaining member comprises a distal end; and deflecting the retaining member comprises deflecting the retaining member such that the thread of the screw passes the distal end of the retaining member.

In some embodiments, rotating the screw comprises sliding the thread of the screw along the distal end of the retaining member.

In some embodiments, inserting the plug into the port comprises making a plurality of electrical connections between a cable attached to the plug and a printed circuit board attached to the receptacle.

In some embodiments, the screw comprises a shaft with the thread extending from the shaft; and pressing the screw into the hole further comprises releasing compressive force on the distal end such that the distal end presses against the shaft.

According to an aspect of the present application, there is provided a receptacle assembly comprising: a housing having a mating face; a plug-receiving port within the mating face; a hole in the mating face; and a metal member within the hole, the metal member comprising a segment, the segment being ramped toward a centerline of the hole.

In some embodiments, the metal member is springy.

In some embodiments, the hole is bounded by at least one wall; the segment is a first segment; and the metal member comprises a second segment, the second segment being parallel to a wall of the at least one wall and the first segment joined to the second segment at an acute angle.

According to an aspect of the present application, there is provided a receptacle assembly, in combination with a plug, the plug comprising: a shell; and a screw comprising a thread, wherein: at least a portion of the plug is positioned within the plug-receiving port; the segment of the metal member has a distal end; and the screw is inserted in the hole with the distal end of the segment engaging the thread of the screw.

In some embodiments, the combination further comprises a printed circuit board mounted adjacent a panel of an electronic device, the panel comprising an opening and the plug-receiving port and the hole being positioned in the opening.

Accordingly, the invention should be limited only by the attached claims.

What is claimed is:

1. A receptacle adapted for mounting to a printed circuit board, the receptacle being configured to receive a member inserted in an insertion direction, and the receptacle comprising:

a housing, the housing comprising a first portion with a first cavity and a second portion with a second cavity, the first cavity being bounded by a first surface and an opposing second surface, and the second cavity being bounded by a third surface and an opposing fourth surface;

a first plurality of conductive elements, a second plurality of conductive elements, a third plurality of conductive elements, and a fourth plurality of conductive elements, each conductive element of the first, second, third and fourth pluralities of conductive elements comprising a tail adapted for attachment to the printed circuit board, a mating contact portion and an intermediate portion coupling the tail to the mating contact portion, wherein:

the mating contact portions of the first plurality of conductive elements are disposed along the first surface of the first cavity;

the mating contact portions of the second plurality of conductive elements are disposed along the second surface of the first cavity;

the mating contact portions of the third plurality of conductive elements are disposed along the third surface of the second cavity;

the mating contact portions of the fourth plurality of conductive elements are disposed along the fourth surface of the second cavity;

the first portion is offset, relative to the second portion, in the insertion direction.

2. The receptacle of claim 1, wherein the first surface, the second surface, the third surface and the fourth surface are parallel.

3. The receptacle of claim 1, wherein:

the housing has a lower surface; and the tails of the first, second, third and fourth pluralities of conductive elements extend through the lower surface.

4. The receptacle of claim 3, wherein the housing further comprises a projection extending from the lower surface.

5. The receptacle of claim 1, wherein:

the housing is insulative; and the receptacle is in a combination with a conductive cage, the conductive cage comprising a rectangular opening, wherein the first portion is closer to the rectangular opening than the second portion.

6. The receptacle in the combination of claim 5, wherein the cage comprises a body portion and an end portion, the end portion comprising an EMI seal.

7. The receptacle of claim 1, wherein the first cavity comprises a first port and the second cavity comprises a second port.

8. The receptacle of claim 1, in combination with a plug and the printed circuit board, the receptacle being mounted to the printed circuit board and the plug comprising:

the member, wherein the member is a first member having a first side and a second, opposing, side;

a second member having a third side and a fourth, opposing, side;

a fifth plurality of conductive elements, an sixth plurality of conductive elements, a seventh plurality of conductive elements, an eighth plurality of conductive elements, each conductive element of the fifth, sixth, seventh and eighth plurality of conductive elements comprising a tail adapted for attachment to a cable, a mating contact portion and an intermediate portion coupling the tail to the mating contact portion, wherein:

the mating contact portions of the fifth plurality of conductive elements are disposed on the first side of the first member;

the mating contact portions of the sixth plurality of conductive elements are disposed on the second side;

the mating contact portions of the seventh plurality of conductive elements are disposed on the third side;

the mating contact portions of the eighth plurality of conductive elements are disposed along the fourth side;

the first member is inserted in the first cavity;

the second member is inserted in the second cavity;

the second member extends, in the insertion direction, beyond the first member.

9. A plug adapted for engaging a receptacle, the plug comprising:

a first sub-assembly comprising:

a first insulative housing; and a first plurality of conductive elements held by the first insulative housing, each of the first plurality of conductive elements comprising a mating contact portion;

a second sub-assembly comprising:

a second insulative housing; and a second plurality of conductive elements held by the second insulative housing, each of the second plurality of conductive elements comprising a mating contact portion; and a support structure having a mating end adapted to engage the receptacle, wherein the first sub-assembly is attached to the support structure at a first distance from the mating end and the second sub-assembly is attached to the support structure at a second distance, greater than the first distance, from the mating end.

10. A plug adapted for engaging a receptacle, the plug comprising:

a first sub-assembly comprising:

a first insulative housing; and a first plurality of conductive elements held by the first insulative housing, each of the first plurality of conductive elements comprising a mating contact portion;

a second sub-assembly comprising:

a second insulative housing; and a second plurality of conductive elements held by the second insulative housing, each of the second plurality of conductive elements comprising a mating contact portion; and a support structure having a mating end adapted to engage the receptacle, wherein the first sub-assembly is attached to the support structure at a first distance from the mating end and the second sub-assembly is attached to the support structure at a second distance, greater than the first distance, from the mating end, wherein:

the support structure comprises a first support structure segment and a second support structure segment arranged to provide an L-shaped profile; and the first sub-assembly is mounted in the first segment and the second sub-assembly is mounted in the second segment.

11. The plug of claim 10, wherein:

the mating contact portions of the first plurality of conductive elements are disposed in a first plane; and the mating contact portions of the second plurality of conductive elements are disposed in a second plane, the second plane being parallel to the first plane.

12. The plug of claim 11, wherein:

the mating contact portion of each of the first plurality of conductive elements comprises a conductive pad exposed in a surface of the first insulative housing; and the mating contact portion of each of the second plurality of conductive elements comprises a conductive pad exposed in a surface of the second insulative housing.

13. The plug of claim 12, in combination with the receptacle, wherein:

the receptacle comprises a housing with a first housing portion and a second housing portion arranged to provide an L-shaped profile, the receptacle comprising a first port adapted to receive the first sub-assembly and a second port adapted to receive the second sub-assembly, the first port being formed in the first housing portion and the second port being formed in the second housing portion.

14. A receptacle configured to receive at least a portion of a plug when the plug is inserted in an insertion direction, the receptacle comprising:

a housing comprising:

a lower surface adapted for attachment to a printed circuit board; and a first port and a second port in a mating face, the first port being offset from the second port in the insertion direction; and a first plurality of conductive elements and a second plurality of conductive elements held within the housing, each conductive element of the first and second pluralities comprising a mating contact portion, the mating contact portions of the first plurality of conductive elements being disposed in a first linear array within the first port and the mating contact portions of the second plurality of conductive elements being disposed in a second linear array within the second port.

15. The receptacle of claim 14, wherein:

the first port comprises a first cavity;

the second port comprises a second cavity;

the mating contact portion of each of the first plurality of conductive elements comprises a compliant beam extending into the first cavity; and the mating contact portion of each of the second plurality of conductive elements comprises a compliant beam extending into the second cavity.

16. The receptacle of claim 15, wherein:

the first port and the second port are positioned within the housing such that the first cavity and second cavity open in a forward face of the receptacle housing, the forward face having a first forward face portion at a mating end of the receptacle and a second forward face portion at a distance from the mating end of the receptacle.

17. The receptacle of claim 16, in combination with the plug, the plug comprising a forward face, the forward face of the plug comprising a contour conforming to a contour of the forward face of the receptacle in one orientation of the plug, whereby the plug is adapted for mating with the receptacle in a single orientation.

18. A plug adapted for engaging a receptacle having a plurality of ports, the plug comprising:

a support structure having a mating end and a cable attachment end;

a first planar insulative member comprising a first edge facing the mating end and a second edge facing the cable attachment end;

a second planar insulative member comprising a first edge facing the mating end and a second edge facing the cable attachment end, wherein the first edge of the first planar insulative member is further from the mating end than the first edge of the second planar insulative member;

a first plurality of conductive elements, each of the first plurality of conductive elements comprising a tail disposed adjacent the cable attachment end and a mating contact portion disposed in a first array though a surface of the first planar insulative member; and a second plurality of conductive elements, each of the second plurality of conductive elements comprising a tail disposed adjacent the cable attachment end and a mating contact portion disposed in a second array through a surface of the second planar insulative member adjacent the mating end.

19. The plug of claim 18, wherein the first planar insulative member and the second planar insulative member are exposed through an opening of the support structure.

20. The plug of claim 19, wherein:

the surface of the first planar insulative member is a first surface of the first planar insulative member and the first planar insulative member comprises a second surface;

the surface of the second planar insulative member is a first surface of the second planar insulative member and the second planar insulative member comprises a second surface;

the plug further comprises:

a third plurality of conductive elements and a fourth plurality of conductive elements, each of the third plurality of conductive elements comprising a tail disposed adjacent the cable attachment end and a mating contact portion disposed in a third array though the second surface of the first planar insulative member; and each of the fourth plurality of conductive elements comprising a tail end disposed adjacent the cable attachment end and a mating contact portion disposed in a fourth array though the second surface of the second planar insulative member.

* * * * *